US005964065A

United States Patent [19]

Migurski et al.

[11] Patent Number: 5,964,065

[45] Date of Patent: Oct. 12, 1999

[54] ADVANCED SURGICAL SUITE FOR TRAUMA CASUALTIES (AZTEC)

[75] Inventors: Tomasz K. Migurski, San Jose; Tai Y. Chung, San Francisco; Theekarat Lertphumpanya, San Jose; Stefano A. Moris, Piedmont; Brian D. Perry; David C. Windham, both of San Jose, all of Calif.

[73] Assignee: San Jose State University Foundation, San Jose, Calif.

[21] Appl. No.: 08/995,962

[22] Filed: Dec. 22, 1997

Related U.S. Application Data

[60] Provisional application No. 60/033,444, Dec. 20, 1996.

[51] Int. Cl.[6] ..... E04B 1/343

[52] U.S. Cl. ..... 52/64; 52/79.5; 52/66; 52/67; 52/71

[58] Field of Search ..... 52/79.5, 64–72; 135/88.17, 88.18, 143, 149, 151, 152, 900, 901; 312/198, 334.27, 334.29, 334.31, 334.32

[56] References Cited

U.S. PATENT DOCUMENTS

| | | | |
|---|---|---|---|
| D. 246,990 | 1/1978 | Rain . | |
| 1,100,273 | 6/1914 | Wiard | 135/152 |
| 1,499,972 | 7/1924 | Canfield | 135/153 |
| 2,765,499 | 10/1956 | Couse | 52/79.5 |
| 2,793,067 | 5/1957 | Couse | 296/23 |
| 2,904,850 | 9/1959 | Couse et al. | 52/79.5 |
| 3,103,709 | 9/1963 | Bolt | 52/79.5 |
| 3,727,753 | 4/1973 | Starr | 52/79.5 |
| 3,840,267 | 10/1974 | Honigman | 52/64 |
| 3,984,949 | 10/1976 | Wahlquist . | |
| 4,034,772 | 7/1977 | Huddle . | |
| 4,458,864 | 7/1984 | Colombo et al. . | |
| 4,478,467 | 10/1984 | Tyndall . | |
| 4,570,733 | 6/1987 | Star . | |
| 4,603,518 | 8/1986 | Fennes | 52/64 |
| 4,633,626 | 1/1987 | Freeman et al. | 52/79.5 |
| 4,644,705 | 2/1987 | Saccomani et al. | 52/79.5 |
| 4,707,953 | 11/1987 | Anderson et al. . | |
| 4,739,597 | 4/1988 | Voegeli et al. . | |

(List continued on next page.)

*Primary Examiner*—Carl D. Friedman
*Assistant Examiner*—Phi Dieu Tran A
*Attorney, Agent, or Firm*—Heller Erhman White & McAuliffe; Jacques M. Dulin; Robert F. Dennis

[57] ABSTRACT

Advanced vehicle-transportable field emergency medical systems comprising surgical suites deployable from core modules, each expanding to form an enclosed surgical or treatment room with perimeter tenting spaces, supplies and equipment. Two system versions are disclosed, each containing operating rooms, post operative beds, and a twenty plus bed triage capacity with unidirectional patient flow. The first surgical procedure can begin within one hour of delivery with a twenty patient cycle for twenty four hours. The surgical/treatment modules may also be deployed independently. Both system versions are transportable in a single C130 transport aircraft. Version AZ1 has smaller modules deployable by utility helicopter that include two operating suites, two post operative units, and also supply/communications and power units. Version AZ2 includes two modules each forming a combined surgical/post-operative unit, and also supply/communications and power units. Each lightweight core module deploys to form a room of over twice its original volume, exclusive of attached tented triage/post-op spaces. A combination of hinging side panels, floor plates, and telescoping space frames and cabinets create a sturdy self-locking core structure. An air filtration/conditioning system and passageway airlocks maintain positive pressure in the operating/post-op rooms for contamination prevention. The deployed system layout provides efficient patient movement and avoids cross-contamination. Lightweight tenting is supported from the deployed modules, e.g. by pylons/spars, panels and curved battens, creating an enclosed, compound surface which withstands weather loads. Telescoping, airlocked supply cabinets are accessible from the inside and outside of the operating room, to preserve positive pressure.

20 Claims, 35 Drawing Sheets

U.S. PATENT DOCUMENTS

| | | | |
|---|---|---|---|
| 4,741,133 | 5/1988 | Kutzner | 52/79.5 |
| 4,779,514 | 10/1988 | Prigmore et al. . | |
| 4,915,435 | 4/1990 | Levine . | |
| 4,958,874 | 9/1990 | Hededus | 52/79.5 |
| 5,154,469 | 10/1992 | Morrow | 296/26 |
| 5,167,341 | 12/1992 | Morton et al. | 220/346 |
| 5,236,390 | 8/1993 | Young . | |
| 5,237,784 | 8/1993 | Ros | 52/79.5 |
| 5,345,730 | 9/1994 | Jurgensen | 52/64 |
| 5,765,316 | 6/1998 | Kavarsky | 52/79.5 |

ADVANCED SURGICAL SUITE FOR TRAUMA CASUALTIES (AZTEC)

CROSS REFERENCE TO RELATED APPLICATION

This application is based on Provisional Application Ser. No. 60/033,444, filed Dec. 20, 1996, of the same title, the benefit of the filing date of which is hereby claimed under 35 U.S.C. § 1.20.

GOVERNMENT RIGHTS

The United States Government has certain rights by virtue of support under Contract No. DAMD 17-96-M-1695 issued by the United States Army, USAMRAA.

TECHNICAL FIELD

The invention relates to the field of modular transportable field emergency medical facilities, and more particularly to advanced surgical suites deployable from modular containers which themselves form the core structure of a surgical operating theater or intensive care room and which contain tenting, supports therefor, supplies and equipment.

BACKGROUND ART

Natural disasters, military battles, acts of civil unrest or riot, refugee camps, and epidemics are marked by medical emergencies. Most occur at sites remote from traditional fixed medical treatment facilities such as hospitals or clinics. It is critical to reducing fatalities to provide medical treatment and emergency surgery to stabilize injuries within the first few hours after occurrence, with the best chance of recovery being if that treatment is provided within an hour. This critical time period is called "the golden hour".

While the military has tent-type field "hospitals", such as popularized in the TV series MASH, and well-trained paramedics for battlefield triage and recovery of the wounded, such units are typically general purpose field tents housing surgical equipment rather than being special use facilities designed and constructed to support the requirements of modern emergency surgery and treatment. Such tent medical facilities can take a minimum team of 6–10 soldiers up to a day to erect and make operational.

Further, the current civilian and military systems rely on triage and stabilization near the site of injury, and relies on helicopter or other evacuation to rear field hospitals. The elapsed time to medical treatment to stabilize injuries and emergency surgery, while desired to be as short as possible, is typically over an hour away There is no similar civilian system for natural disaster medical support such as hurricanes, tornadoes, floods, earthquakes, typhoons, forest fires, bombings, chemical or germ incidents, and the like.

DISCLOSURE OF INVENTION

It is among the objects and advantages of the present invention to provide an advanced mobile surgical suite system for the treatment of trauma victims which can be deployed as close as possible to the site of injuries for aggressive life saving and surgical stabilization by an emergency surgeon and necessary support staff.

It is a further object and advantage of the invention to provide an advanced surgical suite system which supports advanced diagnostics, resuscitation and telemedicine equipment.

It is a further object and advantage of the invention to provide an advanced surgical suite system that can be fully contained in a envelope of most popular transport aircraft, such as the C-130 aircraft, and has broad logistic flexibility and high capacity.

It is a further object and advantage of the invention to provide an advanced surgical suite system deployable so that the first treatment procedure can be underway as soon as possible and in less than approximately one hour after delivery to the site by either helicopter or ground vehicle, that can be set up with only about a four member support team, and which can be supplied and resupplied quickly for continuous, intensive operation over 24 hours or more.

It is a further object and advantage of the invention to provide an advanced surgical suite system which is adaptable to be deployed in various sizes and capacities, from a minimum configuration comprising a single operating room, up to a full configuration comprising at least two operating rooms and two intensive Post-Op stations, having a capacity of about 24 triage patients and some 20 procedures in 24 hours, or about 50–70 operations in three days.

It is a further object and advantage of the invention to provide an advanced surgical suite system which is climatically controlled through use of a modular and flexible HVAC unit which is configured for various size operations.

It is a further object and advantage of the invention to provide an advanced surgical suite system which is configured for an efficient operating room set-up, and for optimum patient, personnel and supply traffic patterns within the Post-Op or OR unit.

It is a further object and advantage of the invention to provide an advanced surgical suite system which includes infrastructure of power, climate control, lighting, water, drain and waste plumbing, communications, and the like.

It is a further object and advantage of the invention to provide an advanced surgical suite system which is structurally suitable and rugged for transportation, deployment and knock-down; and which is adaptable to a variety of deployment site requirements such as weather, terrain, and also to military requirements such as hardenability.

It is a further object and advantage of the invention to provide an advanced surgical suite system which provides ease of maintenance, including cleaning between procedures; reduced chance of microbial contamination by airlocks and positive pressure supply to the operating room; the ability for resupply and refitting without disrupting ongoing operations, and the capability of replacing primary and secondary systems in minimal time.

AZTEC System Overview: The AZTEC system (the system name is derived phonetically from Advanced Surgical Suite for Trauma Casualties or ASSTC) is an advanced mobile surgical suite system for the treatment of trauma victims designed to permit a more aggressive surgical life-saving procedure by providing a mobile system that can be brought closer to the site of injuries and eliminates some echelons of care appropriate for the level of emergency of the situation.

The physical embodiment of the system may be summarized as a system of expandable and telescoping modular units that are suitable for transport by air as compact containers, and that are rapidly transformable on site into hard-walled, well-equipped medical/surgical treatment rooms surrounded by attached tented perimeter areas for triage, post-op care and other medical support functions. The containerized, modular nature of the system allows for partial deployment and flexible applications in a variety of military and civilian operations.

The system, equipment and methods are designed to fit an overall doctrine that includes emergency surgeons and well trained paramedics, supported by advanced diagnostics, resuscitation, life support, monitoring and telemedicine equipment. In this doctrine, non-critical casualties are diagnosed and treated by paramedics at the site of the injury and evacuated to a more distant fixed facility. More severe casualties that require aggressive stabilization before evacuation are delivered to a nearby AZTEC facility and receive treatment within the golden hour, before being evacuated to a fixed, more distant facility for corrective surgery.

The AZTEC system is thus a bridge between the site of the trauma and a fixed hospital with a full suite of care echelons. The AZTEC system permits emergency and stabilization care, supported by enhanced communication and telemedicine technologies for remote diagnostics and assistance, to be administered more rapidly than transport to a fixed hospital would permit.

The AZTEC unit as deployed and set up includes three major sub-systems; Triage, Operating Room ("OR") and Post-Operative suites, for surgical stabilization and preparation for evacuation. Following triage, those who are the most severely traumatized are immediately treated and stabilized in the AZTEC unit. Those patients are then transported to a fixed hospital, typically within an eight hour period.

In this regard, the AZTEC system provides a method of rapid response of trauma injuries in various civilian as well as military emergencies. AZTEC units may be maintained on standby status at various strategic locations, for example, military bases, national guard bases, major civilian airports or regional hospitals. A service organization, such as an experienced HMO, can maintain a roster of doctors, nurses, paramedics and support staff who have been through an extensive course of training exercises using the AZTEC system in simulated or real emergencies. When the emergencies occur, such as an earthquake, the AZTEC units can be airlifted by helicopters to a suitable local site, preferably one that is pre-selected. Within an hour or less of arrival, the unit can be set up sufficiently to receive its first triage patients and start surgery.

The AZTEC systems include capability for triage, surgical prep, surgical operations, post-operative evaluation and care, and evacuation preparation. Each system comprises a portable structure for carrying out these functions. Thus, the AZTEC system fits well within the current emergency medical response infrastructure. In addition to the use of the AZTEC system for surgical medical emergencies, they can be outfitted for other medical or epidemiological functions as well as for refugee or disaster victim support functions. One important aspect of the medical response capability is that it may be specially outfitted for epidemic or contagious outbreak, such as the Ebola disease outbreak in Africa, or for treatment of refugees, as in Bosnia or the Rwanda/Zaire conflict, or for germ or chemical exposure of civilian or military population.

AZTEC embodiments: AZTEC 1 and AZTEC 2("AZ1" and "AZ2") are two preferred versions or embodiments of such a facility which will be described in detail. These were developed for two modes of air transport utilizing widely deployed aircraft types: air transport aircraft, such as the C-130 cargo plane, and helicopters, such as the Blackhawk helicopter or equivalent. Each embodiment contains two operating rooms, four intensive care post-operative beds, and a twenty four bed triage capacity. Once delivered and positioned, the units can be rapidly deployed (20–30 minutes for the AZ1 and 40–60 minutes for the AZ2) as basic operating rooms, post-operative rooms or other types of intensive care units. Integral with the system are perimeter tenting areas surrounding the hard units and facilitating triage and other medical support functions.

The first surgical procedure can begin in less than one hour of system delivery, with a continuing treatment capacity of approximately twenty patient cycles in twenty four hours or some 60 patients in three days. Both versions are designed around the cargo capacity of a C130 transport aircraft, and require only about four support persons for set-up, with minimal supply/re-supply time. It should be noted that the AZTEC-1 or 2 systems can be carried aboard ship and deployed from ship to shore by helicopter, or deployed on sites such as drilling platforms or barges.

AZ1 consists of five and a half smaller containers that include an operating suite, a post operative unit, a second operative suite, a second post operative unit, a supply and communications unit, and a power unit. The smaller size and approximate 4,000 lb. weight of AZ1 module allows for transport by a Blackhawk helicopter, thus creating a high level of mobility.

AZ2 consists of four containers; an operative/post-operative module, a second operative/post-operative module, a supply/communications module, and a smaller power/utilities module. The supply/communications module is preferably built as a modified AZ1 post-op module to also provide crew relief and support functions in extended operations.

AZTEC 1: Four hard points at the top of each unit accommodate air transport while the combination of a tow bar and bottom skid plate allow for land based movement. Once AZ1 is delivered, the unit is rapidly deployed to over twice its original volume. A combination of hinging panels, drop-in floor plates, and sliding containers create a sturdy self-locking structure. Once the primary structure has expanded, the integrated tenting is deployed. Consisting of lightweight material and stiff battens, the tenting construction resembles that of modern racing sails.

There are preferably two climate control systems for redundancy, located on the roof of the unit. These systems are responsible for air filtration, temperature control, and the maintenance of positive pressure within the unit. Hardening can be accomplished using sandbags placed on top of the core units, and an additional seven foot perimeter ballistic fence for small arms fire. Hard materials in the structure of the core units provide additional protection inside.

AZTEC 1 can be deployed in three different configurations. The first utilizes a full C130 capacity and comprises two operative modules or units, two post operative units, a supply/communications unit, and a power/utilities module. The second, smaller configuration utilizes only one-half of the capacity, and has one operative module, one post operative module, and power and supply modules. The modular nature of the AZ-1 configuration also allows for a third configuration for rapid deployment of a single operating unit adapted to serve both operative and post-operative functions, with a power/utilities module.

The full AZTEC 1 configuration, consisting of distinct operating room modules and post operative modules, has a unidirectional patient flow. Patients enter through one of two polyethylene curtains or membranes, pass through the triage area, through a sub-membrane, into the operating room, out of the operating room, out of the operating module, into the post operative module, into the intensive care room, to the holding and evacuation prep area, and exit be evacuated to conventional hospital follow-up care. The full configuration has a maximum triage capacity of twenty four beds as each of the four units can house six beds. The triage capacities may be doubled by the use of bunk beds. The second deployment configuration contains one half of the full configurations capacities, but is otherwise similar.

In the third rapid deployment configuration both triage and post operative care are performed within the tenting and are separated by a membrane, and it has a triage capacity of up to four stations that could be doubled to eight with a bunk bed configuration, and it has two post operative beds. This configuration is applicable to special forces operations or scenarios where resources are spread thin or sites of injury are dispersed, and allows for the most rapid and flexible deployment to permit the initial stabilization treatment to begin within the "golden hour". As with the other configurations, and the AZ2 embodiment, the medical staff can begin the first surgery while the perimeter tenting is still being deployed by set-up crew. This configuration can be deployed by the use of two Blackhawk helicopters, one carrying the container of the operating/post-op module, and the second helicopter carrying a power/utilities module, an emergency surgeon and the deployment and operating crew of four. Typically, in a minimum response time configuration, the medical and operational personnel will also be trained in deployment and set-up of the unit.

These configurations described above are by way of example and not by way of limitation of the principles of the invention.

AZTEC 2: AZ2, the larger version of the AZTEC, allows for a more unitized facility, but its size does not allow for transport by lighter helicopters. As with AZ1, the combination of a towbar and skid plate allow for land based movement by tank, truck or personnel carrier. Upon delivery, AZ2 is deployed to more than twice its original volume although the time required (about 40–60 minutes) is more than for the AZ1. A similar combination of hinging panels, drop in floor plates, and sliding containers complete this operative and post operative suite. Once the tenting is deployed, triage can begin with the first influx of patients arriving within an hour of delivery. Two redundant climate control systems maintain positive pressure, stepping down from the operating room, to the triage area, and tenting. As with AZ1, hardening can be accomplished using sandbags and perimeter fencing. The AZ2 configuration consists of an operative and post operative area, medical supplies, and a bi-directional patient flow. Patients are brought through the side of the tenting, proceed to the left or right side triage area, then into the operating room, post operative area and exit to state side care. AZ2 has a maximum triage capacity of 24 beds, as each of the two units can house 12 beds. Like the AZ1, the AZ2 can be used in a half configuration as well, and bunkbeds can be used to increase patient capacity.

Common Features: Many aspects of the invention are common to the features of the AZ1 and AZ2 embodiments. The AZTEC units include a central foundation chassis that supports moveable space frames through expandable cantilevered floor beams. Space frames are interconnected by foldable structural side panels. In deployment, the space frames are pulled out from the chassis, and the side panels unfold to enclose the resulting opening to form a box-like operating/treatment room. This room is covered by an integral tenting roof supported by arch-like ribs.

During storage and transport, the space frames are largely filled with wall-mounted telescoping or slide-through equipment/supply containers. Upon deployment, the slide through containers can be instantaneously repositioned from the inward, transport location to the outward, deployed position, thus providing within the space frame additional sealed interior operating room space. In a similar manner, the space frames also contain roof-mounted slide-through air handling and conditioning (HVAC) units, which are extended and telescoped upwards upon deployment to provide headroom clearance within the space frames.

The slide-through wall containers in the deployed position are accessible both from the interior operating room side and from the exterior tented area side to provide a standardized, modular system of housing medical supplies as well as equipment supported by computer network, power and infrastructure hookups. Controlled, two-sided access to the containers or cabinets, which are accessible from the inside and outside of the operating or post-op room, allows for re-supply of the operating rooms without entry, and provides equipment and supply support for patients in the perimeter tented areas. However, the cabinets preferably include interlocks so that one cannot access one side if the other is open, thus preserving positive pressure environment in the operating room.

Sealed interior spaces and successive membranes support positive air pressure and controlled air flow. Membrane-type airlocks which control airflow in doorsways and partition openings are "soft" plastic sheet door structures mounted to cover the doorway or opening to provided an approximately air-tight closure while providing a quick release/reseal means to permit the airlock to be easily opened for passage and then resealed to maintain positive pressure.

Extendible support jacks included in the space frame allow for fast deployment and leveling of the unit on a wide range of terrain. Integral extendible masts, folding wing panels and guy wires attached to the space frames are deployed to support the perimeter tenting without additional ground-mounted structures or staking, and provide uninterrupted interior space. The wing panels protect the tenting elements in the stored/transport position. The tenting roofs employ flexible battens to provide semi-rigid arched batten-and-membrane ceilings over the perimeter enclosure. The arched ceiling over the operating room doubles as a reflector/diffuser for high efficiency overhead lighting and provide extended ceiling height. Folding entry-exit ramps formed from dropped-down side panels serve the doorways of the interior room [O.R.].

Each AZTEC module provides for climatic adaptability through use of one or more HVAC units. The HVAC unit is highly modular and flexible, is configured for various size operations, and provides positive pressure filtered air supply to the operating room which prevents air-borne contamination. The layout and configuration of the AZ1 and AZ2 each provide an efficient operating room set-up with optimum patient, personnel and supply traffic patterns within the Post-Op or OR unit. The AZ1 and AZ2 each have a self-contained system for independent power, climate control, lighting, plumbing and communications. The modules are ruggedized for transportation, deployment and knock-down. The AZ1 and AZ2 are adaptable to a variety of sites and terrain, and are functional in a wide range of weather conditions. In addition, each provides for military requirements, in that each may optionally be "hardened" to provide protection from small arms fire and similar threats.

The AZ1 and AZ2 each provide ease of cleaning between procedures; reduced chance of cross-contamination by pressure locks; the ability for resupply and refitting without disrupting ongoing operations by the double-sided cabinets with interlocks; and the capability of replacing primary and secondary systems in minimal time.

The structure of both AZ1 and AZ2 is preferably comprised of various aluminum extrusions, or alternatively may be constructed of composite materials and sections, These extrusions house both wiring and water ducting. Located at the base of each of several key extrusions is a leveling mechanism. Utilizing power tools or a hand crank, one person can adjust the height of each mechanism, thus leveling the entire unit. Both AZ1 and AZ2 employ triple hinge side panel mechanisms that allow panels to fold flat against themselves.

The tenting material is preferably a lightweight polyamide, stretched taught by extruded composite spars. The seams of each panel are cut with a slight curvature creating a compound surface capable of withstanding moderate load.

Ambient light is provided by high intensity discharge metal halide lamps, with a short term halogen backup system. The light is directed toward the arched ceiling creating diffused light and eliminating shadows. The inside of the ceiling fabric is coated with metal flake to minimize light loss, and maximize diffusion.

The operating and post-op tables may be fully articulated and at least one such table can be stored in the operating or post-op module for immediate use, additional tables and cots being obtained from the supply/communications module. The following is an example of the inventory of equipment and supplies that either the AZ1 or AZ2 may contain: an anesthesia machine, pro pack, oxygen generator, blood refrigerator, blood warmer, x-ray, thoracic box containing four thoracic sets, four neurosurgical sets, 30 suture boxes, abdominal packing supplies, lap sponges and gauze, suction, fluid warmer, infusion pump, syringes and needles, IV fluid consisting of 50 bags of Ringers, 50 bags of normal saline, 200 cans of Albumen, and 200 units of Dexitran, computer and communications equipment, airway supplies including LMA, Ambu bag, and anesthetic and pharmaceutical agents, including muscle blockers, inhalational agents, atropine pressers and dopamine, a primary and secondary autoclave, four general surgical orthopedic surgical sets, four abdominal surgical sets and two headlamps, a second thoracic box, linens and consumables, waste, waste compaction, and a sharps container. The post-operative areas contain additional supplies and can support the extended, tented triage area.

The AZTEC system of the invention provides two viable solutions for the problem of aggressive life saving and surgical stabilization. Both AZ1 and AZ2 allow for a reduction in the number of echelons of care. Both module types can be delivered rapidly and deployed gradually (progressive deployment), allowing the first procedures to commence quickly. while the rest of the facility is still under deployment. Their lightweight and expandable structures provide protection of the core operating units.

The expandable modular containers provide a standardized mode of housing equipment and supplies. These have two sided operation which allows for resupply without interference with procedures and provides support for patients under the external tenting The containerized modular approach to the whole system allows for partial deployment and flexible applications, which in turn can accommodate a variety of military and civilian operations, and the utilization of improvements medical technology as they occur, including telemedicine.

The key features of the AZTEC system of the invention are:

1. A concept of a totally contained prepackaged unit including the structure with its fully protected and equipped internal unit, medical supplies, medical and communications equipment, and wall and ceiling perimeter tenting.
2. The expandable or transformable nature of the core structure, which is accomplished be means including: 2 or 3 segment space framework, unfolding side panels, drop or folding floor panels, telescoping or slide-through cabinets; and a foundation chassis framework with telescoping cantilever beams, that can be leveled.
3. Two-sided access cabinets having either telescoping or retractable wheels to be pushed or rotated into place from the initial, as-delivered out-of-the-way configuration.
4. The arched and vaulted ceiling structure for OR or Post-op of lightweight plastic membrane or fabric material that acts as a reflector, and tented ceiling gores and struts for completely unobstructed perimeter tented areas for the Triage and Post-Op areas.
5. Use of thin, rigid, high strength panels that may be employed to:
   a. Swing down to create portions of the floor;
   b. Swing up to create a walkway on the roof so that a person can access the HVAC units for service and to emplace sandbags as ballistics protection;
   c. Unfolds to create side walls;
   d. Protects against damage, pilferage and contamination in transit;
   e. Contains folded tenting elements when closed.
   f. Swings up to provide tenting support; and/or
   g. Swings down to create entrance platforms.
6. HVAC units included in the central core console, as delivered, that telescopes up into operating position, and provides a positive pressure to assist in control of contamination.
7. Access to all supplies and equipment from the Triage and Post-Op patient areas without entering the Operating Room. Door interlocks on the cabinetry prevent opening both the OR and Triage side doors simultaneously to maintain a pressure lock.
8. The overall layout of the core structure within the tent, and the patient flow into the unit, from Triage through OR, to Post-Op and to the exterior.
9. Use of hollow structural core framework for:
   a. Telescoping and leveling ground support struts;
   b. Telescoping upper pylons (masts) supporting tented area ceilings and possible camouflage netting;
   c. Water, gases, electricity (power) and computer networks/infrastructure; and
   d. Mechanical support as well as connections to all networks for all supply/equipment containers.

The modular nature of the system allows for the evolution of medical technology and the incorporation of enhancing features, including telemedicine. The integral communications equipment may include remote diagnostic support, remote video monitoring, and remote expert advice and coaching of treatment and procedures. Record keeping can be on site or via remote link.

BRIEF DESCRIPTION OF DRAWINGS

The invention is illustrated on the accompanying drawings, in which.

BEST MODE FOR CARRYING OUT THE INVENTION

The following detailed description illustrates the invention by way of example, not by way of limitation of the principles of the invention. This description will clearly enable one skilled in the art to make and use the invention, and describes several embodiments, adaptations, variations, alternatives and uses of the invention, including what we presently believe is the best mode of carrying out the invention.

In this regard, the invention is illustrated in the several figures, and is of sufficient complexity that the many parts, interrelationships, and sub-combinations thereof simply cannot be clearly or meaningfully illustrated in a single patent-type drawing. Accordingly, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing.

It should also be noted that the best mode embodiments which are described in detail herein were scaled in consideration of the capabilities of the C130 and Blackhawk aircraft, and are representative of a range of embodiments that may be tailored to optimally serve many different specific operational requirements of the user, including alternative means of transport. The details and dimensions of the layout of the medical suites, the specific combinations of surgical and post-op suites, and the specific quantity and type of medical equipment and accessories may be modified by one of ordinary skill in the art to optimally serve a range of medical and non-medical requirements and patient capacities without departing from the spirit of the present invention. Likewise, some of the features described only with respect the AZ1 embodiment may optionally be incorporated into a modified AZ2 embodiment, and vice versa.

Figure 4A:
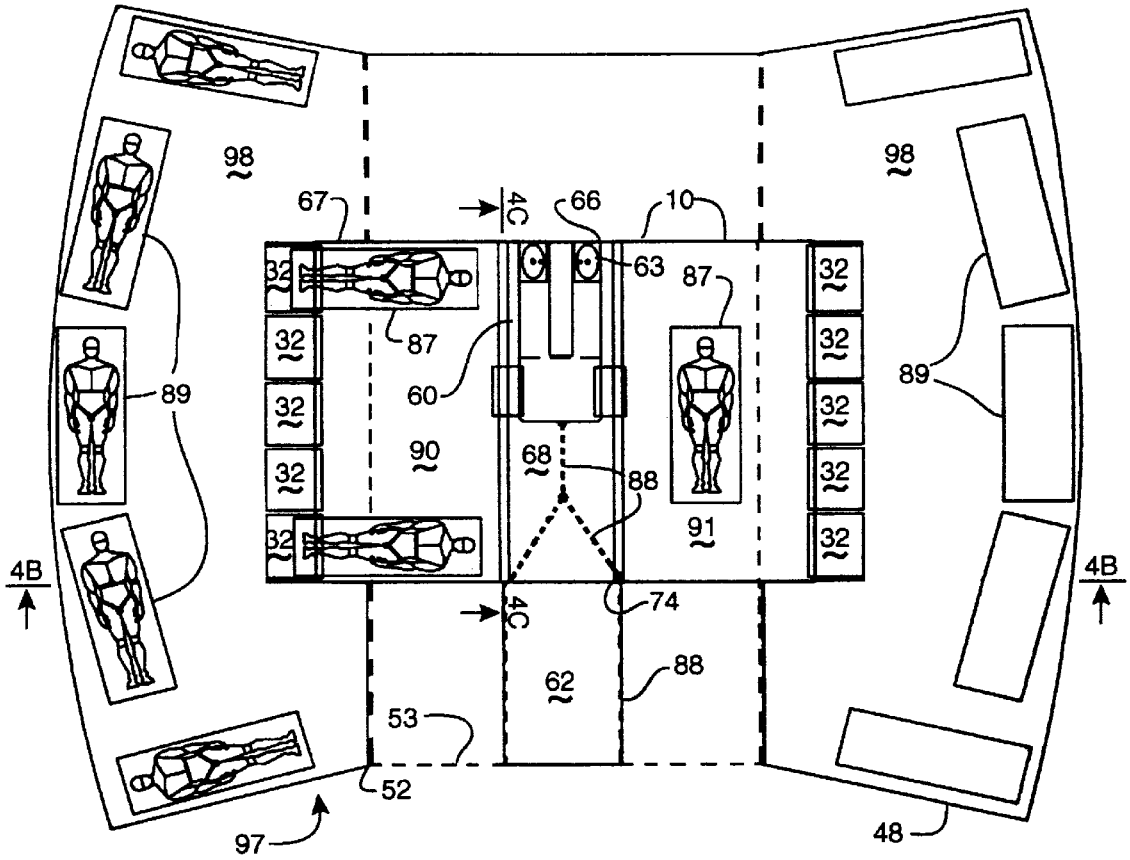
FIGS. 4A, 4B and 4C show the overview of the AZTEC-2 system, FIG. 4A showing the floorplan of the AZ-2, FIG. 4B showing a cross-sectional view from line 4B of FIG. 4A, and FIG. 4C showing a cross-sectional view from line 4C of FIG. 4A.
Figure 4B:
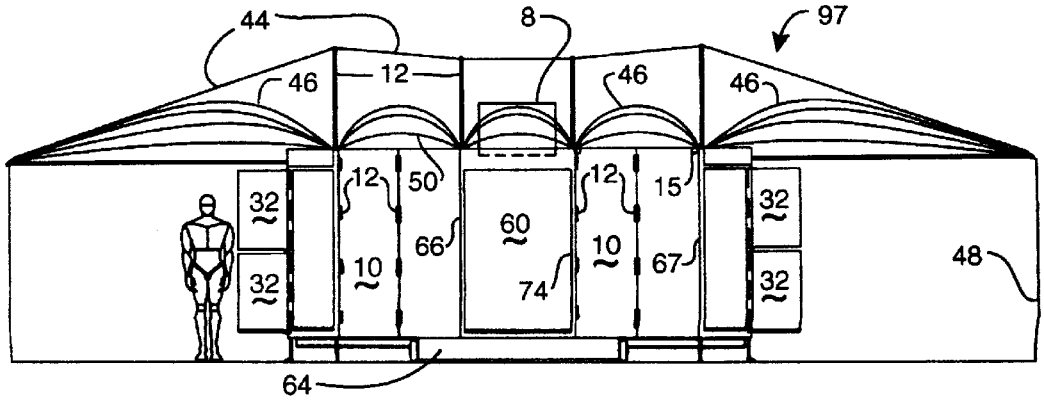
Figure 4C:
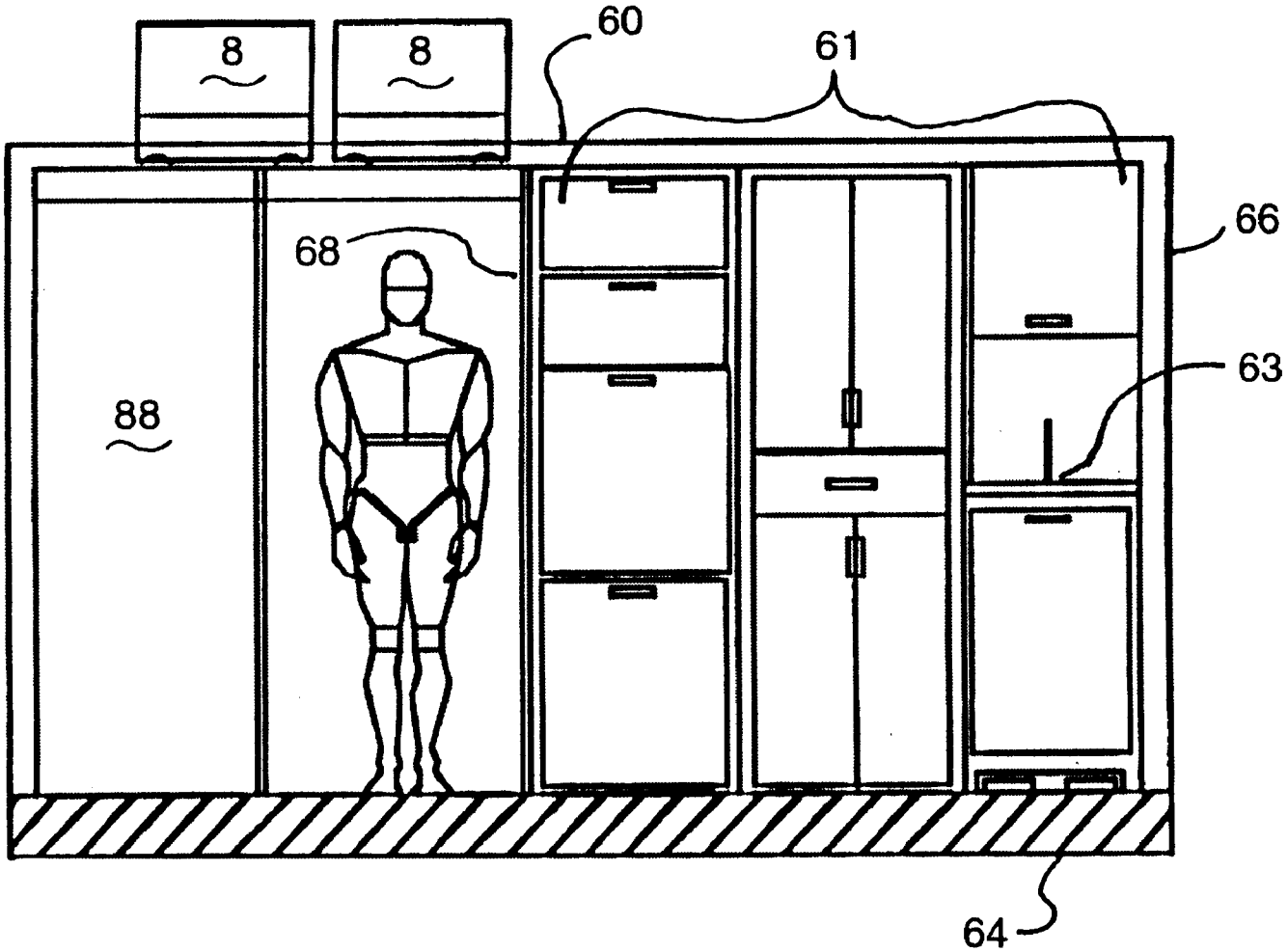
Figure 5:
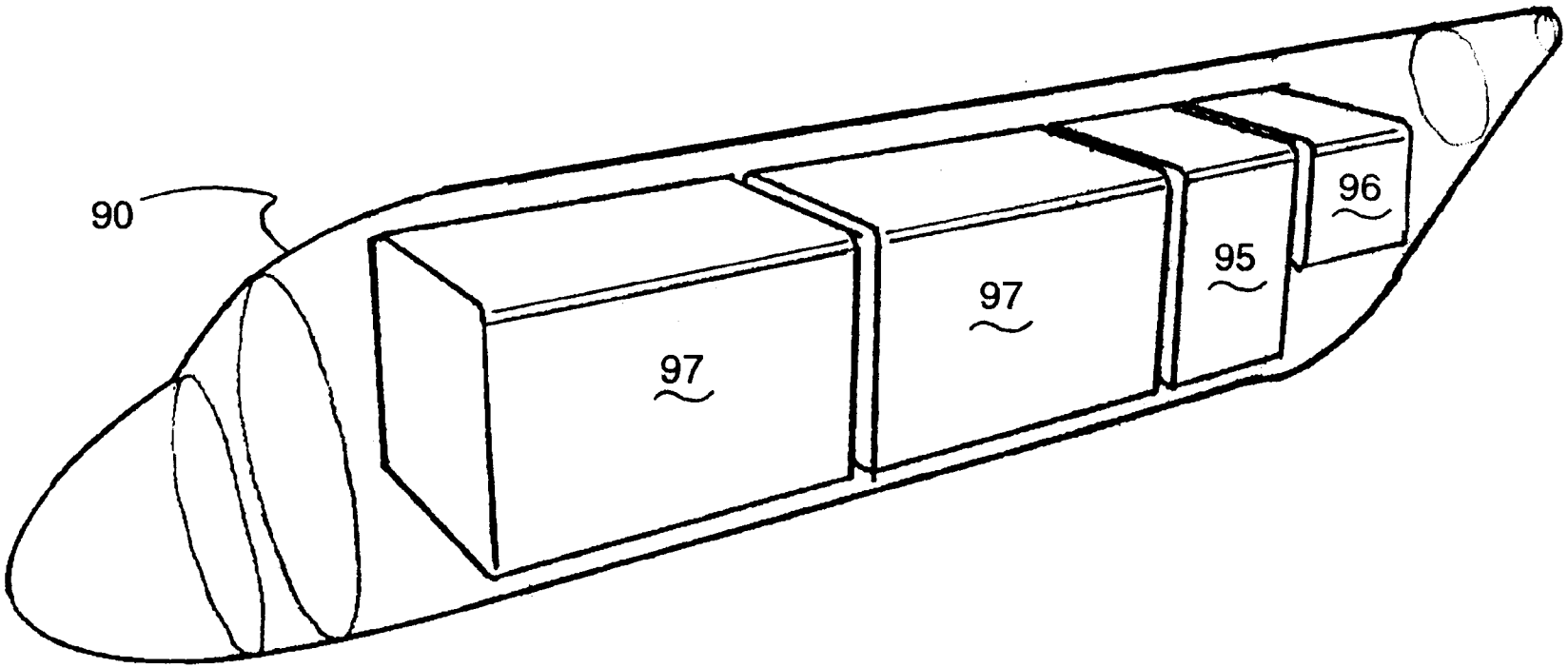
FIGS. 5 shows the modular AZTEC 2 system loaded for transport in a C130 aircraft.

FIGS. 1 through 6 show the transformable and extensible nature of the AZTEC system and illustrate the conversion of the AZ1 and AZ2 modules from an aircraft loadable container to a deployed surgical unit. For clarity the AZ1 is illustrated first, since it incorporates the characteristics of the system of the invention on a smaller scale and with greater structural simplicity than the AZ2, and illustrates the major attributes of the invention which are common to both of the principal embodiments Also, to simplify the figures, certain elements are shown and described in some of the figures, and are omitted from others. FIGS. 1A and 1B first shows the general floorplan and layout of a deployed AZ1 module to provide an overview and frame of reference for the functioning medical unit, and then FIGS. 2 and 3A–F illustrate the sequence of deployment of the system step-by-step from the cargo bay of a C-130 aircraft to a filly deployed module. FIGS. 4, 5 and 6 A–G show the comparable layout and deployment transformation of the AZ2 embodiment. For simplicity and clarity, where certain elements included in both the AZ1 and AZ2 embodiments are structurally and functionally homologous, the same name and figure labels will generally be used to describe such elements for each embodiment, recognizing that the production details, dimensions and installed locations of the elements may differ in use in the different embodiments.

Figure 1A:
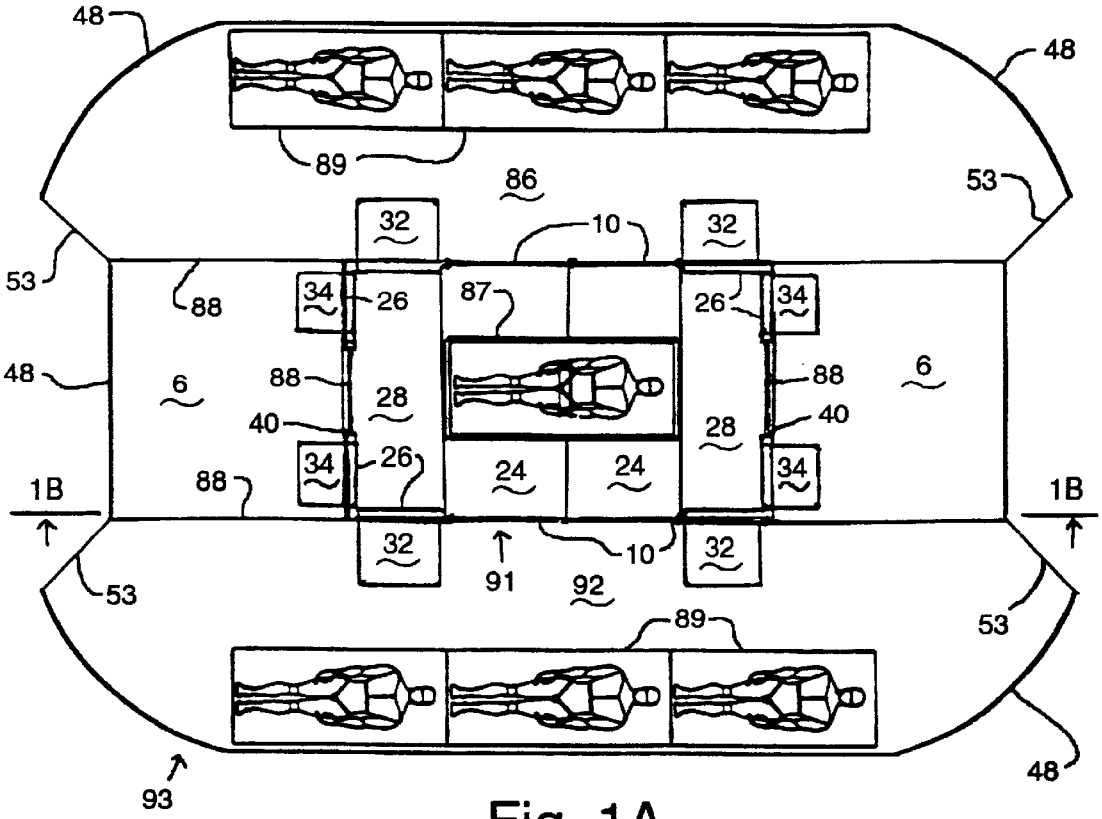
FIGS. 1A and 1B show the overview of the AZTEC-1 system, FIG. 1A showing the floorplan of the AZ-1 and FIG. 1B showing a cross-sectional view from line 1B of FIG. 1A.
Figure 1B:
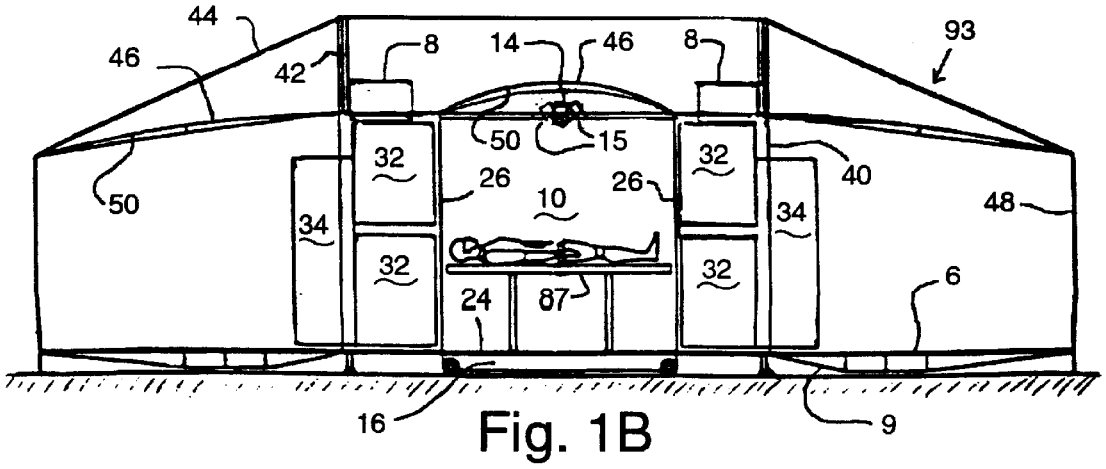

FIGS. 1A and 1B show an overview of an AZTEC-1 operating room module as deployed. FIG. 1A shows the floorplan of the deployed AZ-1 operating suite module 93 and FIG. 1B shows a cross-sectional view of the same module from line 1B of FIG. 1A. The AZ1 is shown illustrating one patient on operating table 87 in the central operating room 91, and with other patients on beds or cots 89 for the tented triage area 86 in the upper portion of the figure and in the post-op area 92 in the lower portion. The AZ1 module is designed around a central foundation chassis 16 (FIG. 1B) which supports two lateral spaceframes or cages 26, shown on the right and left side of the figure, on a system of cantilevered beams (see FIG. 7) that are housed within the chassis 16 to create the interior volume when extended. Hinged sidewalls 10 are unfolded upon deployment of the module to enclose the operating room 91. The operating room floor comprises the folding floor panels 24 which cover the central chassis 16 (Fig. 1B) and space frame floor panels 28 which provide the floor within the two space frames or cages 26.

Double access storage containers for supplies and/or medical equipment surround the perimeter of the operating room 91 and comprise a plurality of slide-through or telescoping cabinets 32 and a plurality of movable cabinets 34. The cabinets are shown in their deployed positions in which they are accessible from both the outside and inside of the operating room 91 but do not intrude into the usable floor space of the operating room. Their two-sided operation allows for resupply and removal of waste material from the operating room without interference with surgical procedures and provides support for patients under the tented triage and post-op areas.

Doorways 40 controlled by membrane-type airlocks 88 open through each lateral cage 26 to exit/entry platforms 6. The platforms preferably are stiffened by retractable stiffening system 9 to permit lightweight thin panel construction, and the stiffener may be a folding plate structure, collapsible strut and cable truss, or the like. The membrane-type airlocks 88 are "soft" door structures mounted to cover a doorway or tent partition opening to provide an approximately air-tight closure. The airlock preferably comprises transparent polymer sheets fastened at a side or center seam by a quick release/reseal means such as zippers or Velcro® type fasteners, to permit the sheet or sheets to be easily opened and drawn aside for passage of personnel or gurneys, and then resealed to maintain positive pressure. Additional membrane-type airlocks 88 may be installed at the lateral margins of the platforms 6 to control airflow to the triage and post-op areas 86, 92.

Air conditioning and filtration (HVAC) units 8 (FIG. 1B) are located on the top of the cages 26 and are shown in their extended position. Duplicate units as shown may be included for redundancy and increased capacity. Like the slide-through cabinets 32, the HVAC unit 8 is extended outward from within the cage during deployment to create additional usable space or headroom within the operating room 91. The HVAC unit creates a slight positive pressure within the operating room, which establishes a consistent flow of conditioned, filtered air through the operating room, which passes out through either optional one-way valves or louvers or through narrow junctions in the panels or doorway locks 88 into the adjacent tented triage and post-op areas. This allows climate control in both areas while the airlocks serve to prevent any sudden disruption of airflow that might allow airborne contamination to backflow from the tented areas to the operating room. This helps to maintain sterility within the operating room in spite of windy or dusty site conditions.

The tenting structure covering the center portion of the operating room and the perimeter areas comprises the tent roof skin 46 and the perimeter curtain wall 48. The roof skin is supported by rib battens 50 and by guy wires or lines 44 mounted to extendible masts or struts 42. The tent roof structure is also supported by folding wing panels 4 (see FIGS. 3E, 3F and 3G). The inside of the tent roof skin 46 covering the central operating room 91 is coated with reflecting and diffusing surface materials similar to that used in photographic studio reflectors. High efficiency metal halide lamps 15 are mounted facing upwards on floating beam 14 (FIG. 1B) above the operating room to provide high intensity diffuse light to the surgical area.

The tent roof 46 and perimeter wall 48 are fully supported by overhead structures mounted to the space frames 26, and require no additional ground mounted poles or struts, maximizing usable space in the perimeter areas and allowing rapid deployment. Stakes or other fixtures (not shown) to secure the perimeter wall to the ground are options available to counter wind forces or in storm conditions. Doorway membranes or closures 53 retractably close the external doorways to the perimeter areas. The embodiments shown do not incorporate built-in or integral flooring in the perimeter areas 86, 92, although optionally tarps, floor panels or other tent flooring can be incorporated in those areas.

For military requirements, small arms and fragment hardening can be achieved by incorporating a ballistic polymer fabric such as Kevlar® into the tent perimeter wall and roof, and similar armoring can be incorporated into the structure of the operating room cabinets and sidewalls. The tenting batten ribs 50 over the operating room may be reinforced by additional stays (see FIG. 6G) to allow a distributed load of protective sand bags to be placed covering the operating room.

Figure 2:
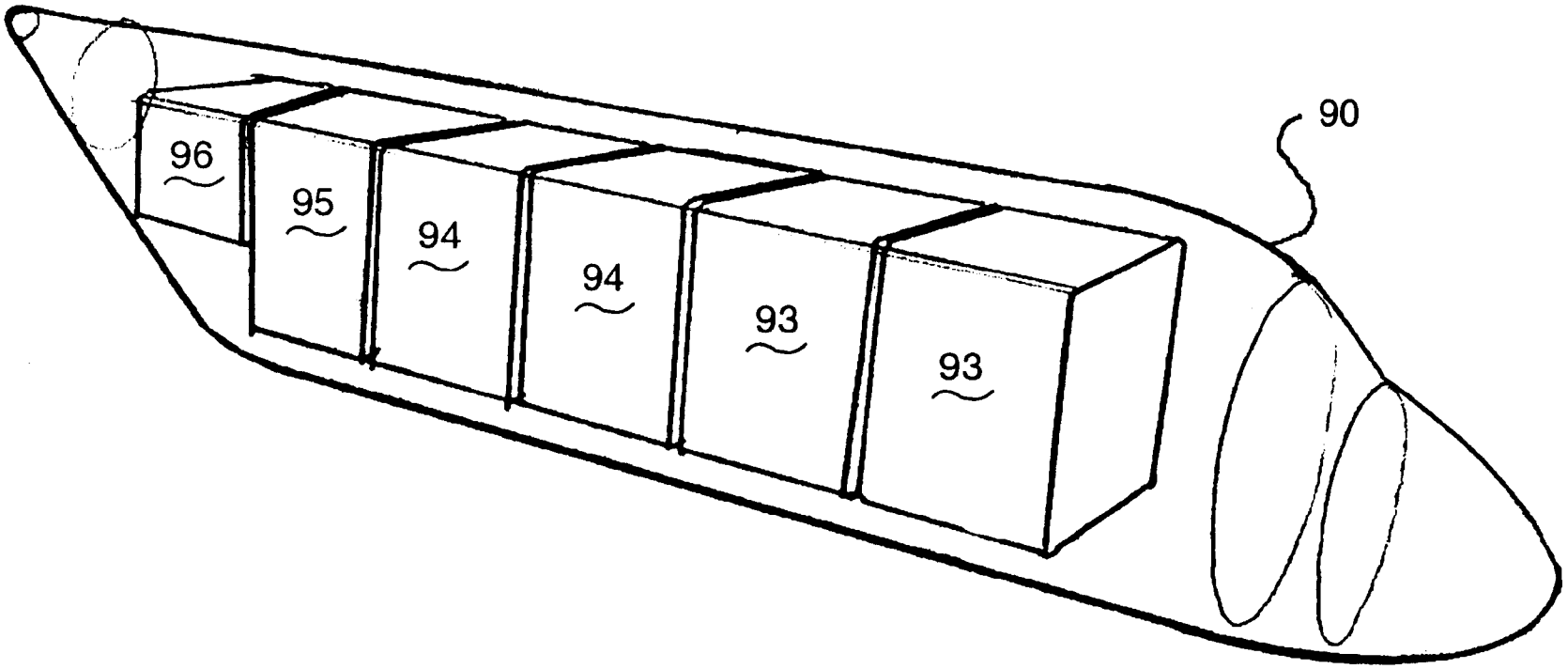
FIGS. 2 shows the modular AZTEC 1 system loaded for transport in a C130 aircraft.

FIGS. 2 illustrates the configuration of the AZTEC 1 system in the fully retracted storage/transport "container" configuration in the cargo bay of a C-130 aircraft. In this configuration the modules resemble and function in a manner similar to conventional air cargo containers, and may have integral tie-down attachments, skid-plates and hooks for hoist or winch attachment for aircraft, fork lift or road vehicle loading and handling. FIG. 2A shows the AZ-1 system in 6 box-like modules: two AZ1 operating suite modules 93, two AZ1 post-operative suite modules 94, one supply and communications module 95, and one smaller power and utilities module 96. The power and utilities module contents include a generator, fuel and, where needed, a transport or working vehicle, such as an ATV or small tractor. The footprint of each of the containers in the best mode embodiment is 8'6"×6'8", and they are 8'6" high, having a weight of up to 4,000 pounds. These 6 containers fill the cargo bay of a single C-130 aircraft.

The modular nature of the AZ-1 configuration also allows for rapid deployment of a single operating unit. The deployment, for example, of a single operating suite 93 or triage/post-op suite 94 can be accomplished by the use of two Blackhawk helicopters, one carrying the full size container of either the operating suite 93 or the Post-Op suite 94 as a conventional sling load attached to hardpoints or hooks on the module, and the second one carrying the power and utilities module 96, plus a deployment and operating crew of about five persons. Typically, the deployment crew will also be trained in operation and maintenance of the unit. Additional support and medical personnel may come in separately. The set-up, deployment and maintenance personnel should also be skilled in operations of the communications gear for the remote diagnostic capabilities of the system. It should be noted that the AZTEC-1 or 2 systems can be carried aboard ship and deployed from ship to shore by helicopter, and can be transported by conventional road vehicles.

FIGS. 3A through 3F show an AZTEC-1 operating suite module 93 through the deployment sequence following site delivery. The deployment of the post-op module 94 is virtually identical with respect to the structure and steps shown in FIG. 3, although the specific equipment and arrangement of accessories is different in light of the differing purpose. The figures are perspective views sharing approximately the same perspective of the module, although the particular angle of view varies somewhat from figure to figure. Various elements which appear in several figures may be labeled in each figure to provide a continuing visual frame of reference, but may not be separately described in each in order to avoid excessive redundancy.

Figure 3A:
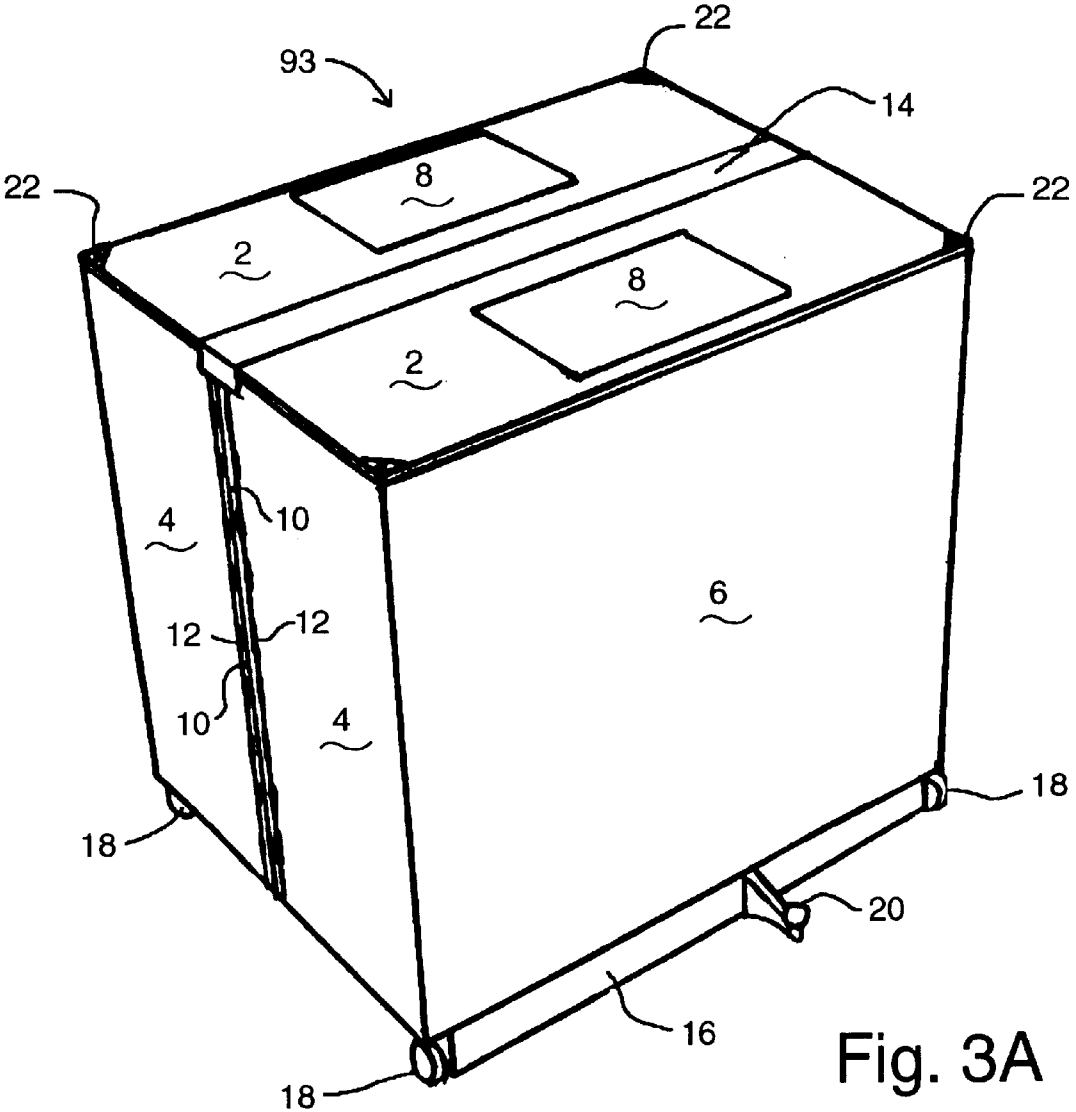
FIGS. 3A through 3F show the sequential step-by step transformation of an AZ1 module from the storage/transport configuration to a fully deployed operating suite.

FIG. 3A shows the module 93 as delivered on the site. The module contains integral recessed sling attachment points or hooks 22 at the upper corners for helicopter transport. The module location is adjusted using tow bar 20, retractable/adjustable wheels 18 and/or bottom skids (not shown). Following site placement, the module is leveled using the level adjustments of the wheels. In the compact transport "container" configuration, certain of the module components are visible at the surface and form the protective enclosure of the container. The entry/exit platform 6 is shown folded up vertically to form the container end, the overhead wing panels 4 are folded down to form the sides of the container, and roof panels 2 and the tops of the retracted HVAC units 8 form the top of the container. The floating beam 14 is seen on top and the ends of the internally folded side panels 10 and side panel hinges 12 are seen at the side. The bottom of the container is the expandable chassis 16 resting on the retractable/adjustable wheels 18, and has the retractable/removable tow bar 20 attached to one end. In this configuration, most of the internal volume of the container consists of the space frames or cages 26 (see FIG. 1 and 3B–E).

Figure 3B:
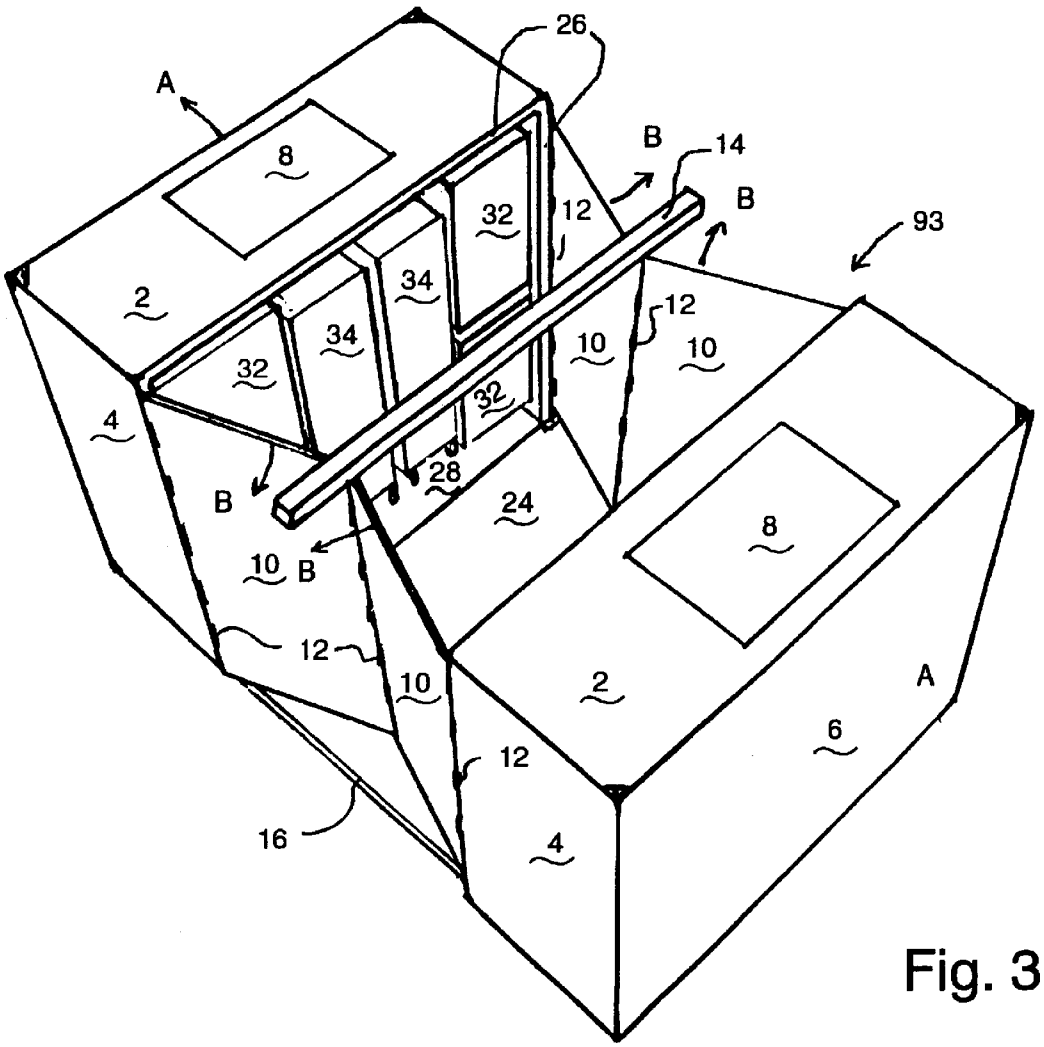
Figure 6B:
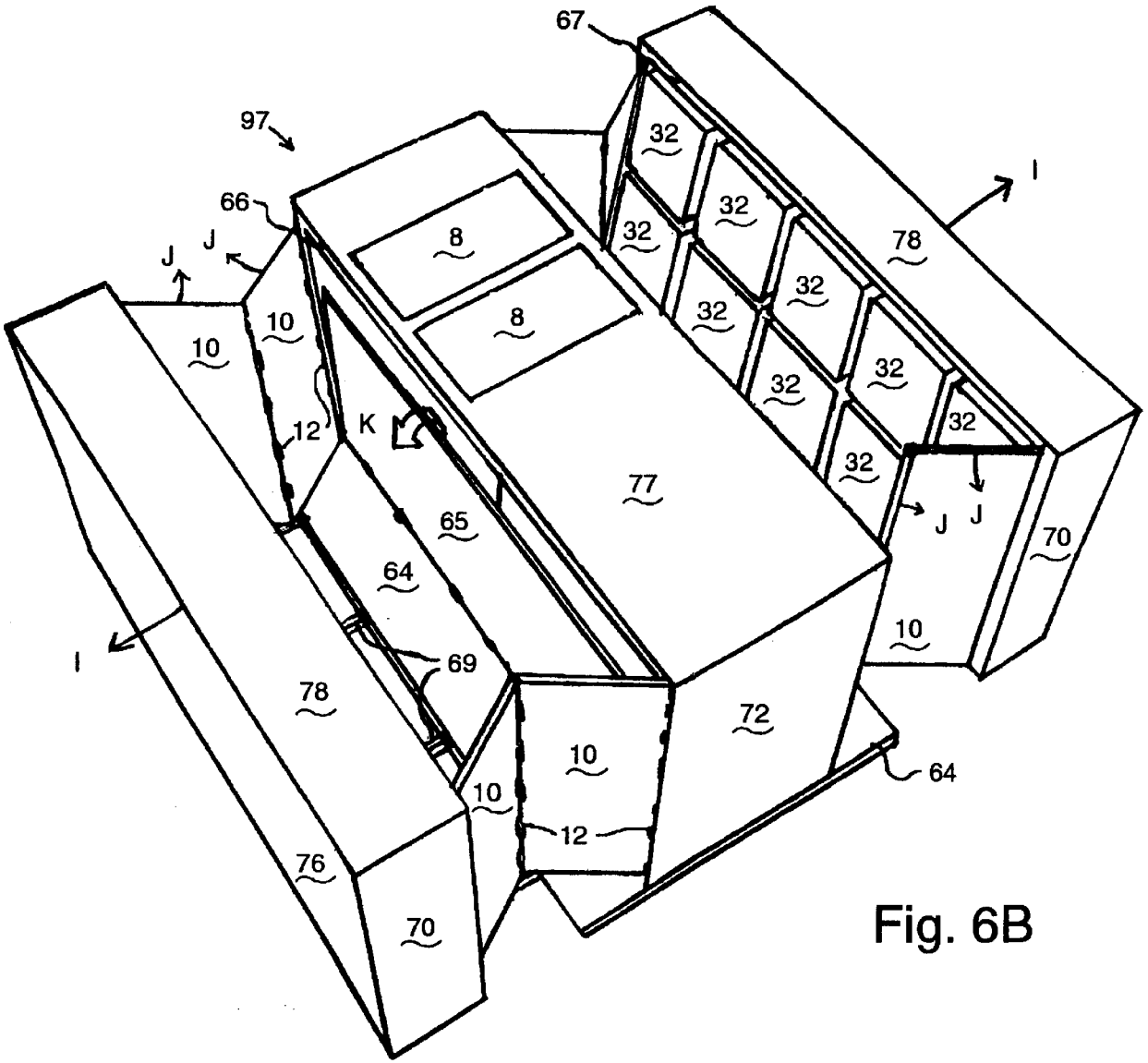
Figure 7:
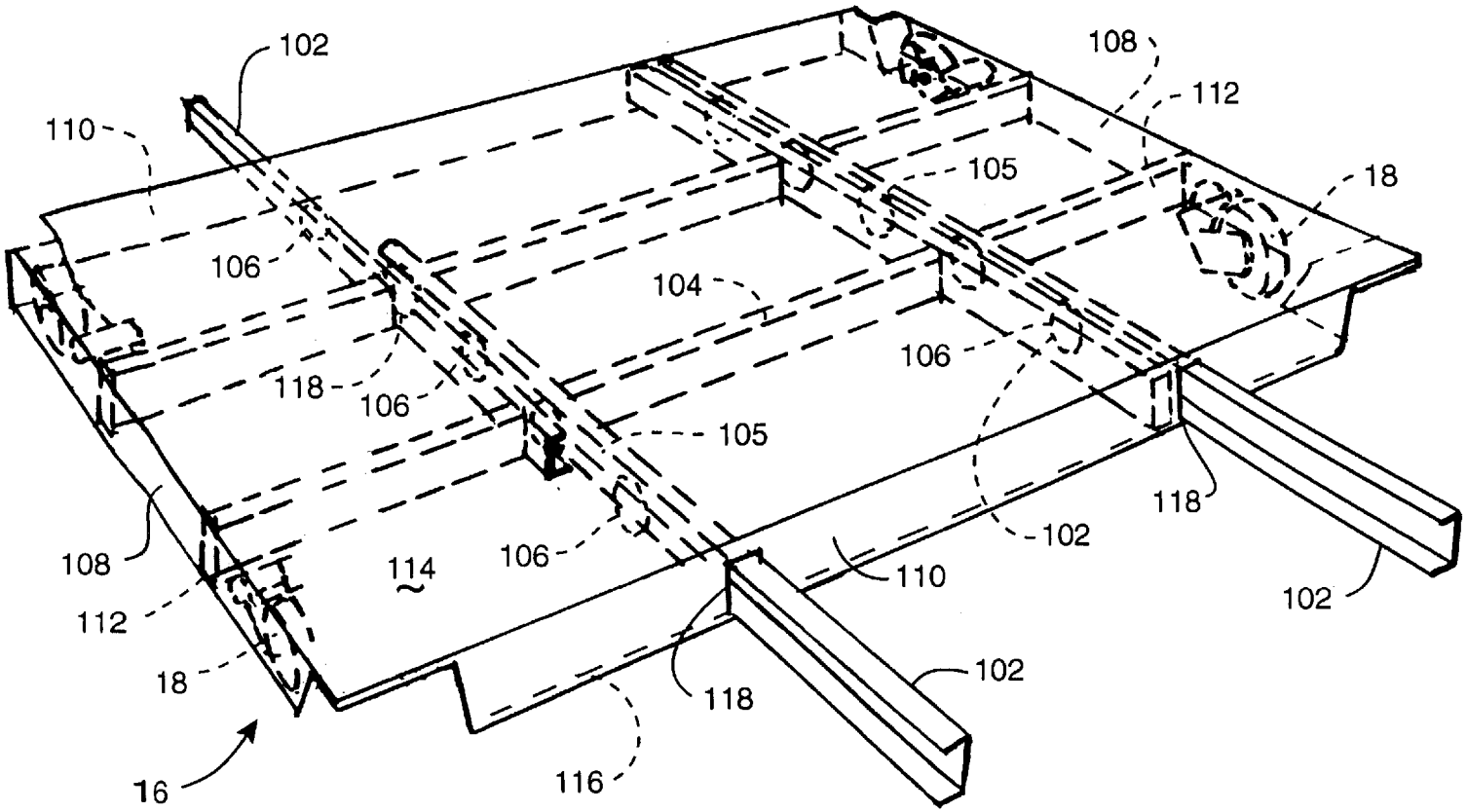
FIGS. 7 and 8 are views of the chassis frame structure and extensible telescoping floor beam system of the AZTEC 1 and 2 systems, respectively.

FIG. 3B shows the module 93 with the space frames 26 partially extended in the direction shown by Arrows A on the telescoping beams contained within extensible chassis 16 (see FIG. 7). The side panels 10 have partially unfolded along three sets of side panel hinges 12 in the direction shown by Arrows B. This is the primary volume increasing combination of the AZTEC system: lateral space frames mounted on an extensible chassis which creates an expanded volume which is enclosed by unfolding sidepanels; the AZ1 having a single expanding combination and the AZ2 having a dual combination (see FIG. 6B). The force to accomplish extension may be applied by manually operated rack and pinion gearing, worm gears, ratchets, hydraulic cylinders or other manual means, or may alternatively be powered by electric motors either internally mounted or mounted in hand-held electrical tools, such as battery powered drills. Each of the panel hinges 12 is preferably a continuous hinge incorporating weather seals, but may comprise a plurality of distinct hinge elements, or may be a flexible membrane or fabric hinge, or the like. The inner top portion of the side panels is mounted to a roller mechanism engaged in a slot in the underportion of the floating beam 14 (see FIG. 10) which move outwardly towards the ends of the beam as the side panels 10 unfold.

It can be seen in FIG. 3B that the space frames 26 are nearly completely filled with retracted and stored components, containing the slide-through cabinets 32, the moveable cabinets 34 and the retracted HVAC unit 8. This efficient use of storage space allows the container to be of minimum size. As the side panels move outward, folding or sliding floor panel 28 is unfolded into place in the central space, and space frame floor panel 28 is shown supporting moveable containers 34. Alternatively, telescoping or removable floor panels may be used to cover the floor plan area exposed as the space frames are extended from the chassis. The floor and side panels are typically lightweight 0.75" to 1.00" thick composite sandwich or honeycomb metal or tough plastic materials The side walls provide small arms fire ballistic protection, and may be doubled or tripled with other anti-ballistic protection as needed.

Figure 3C:
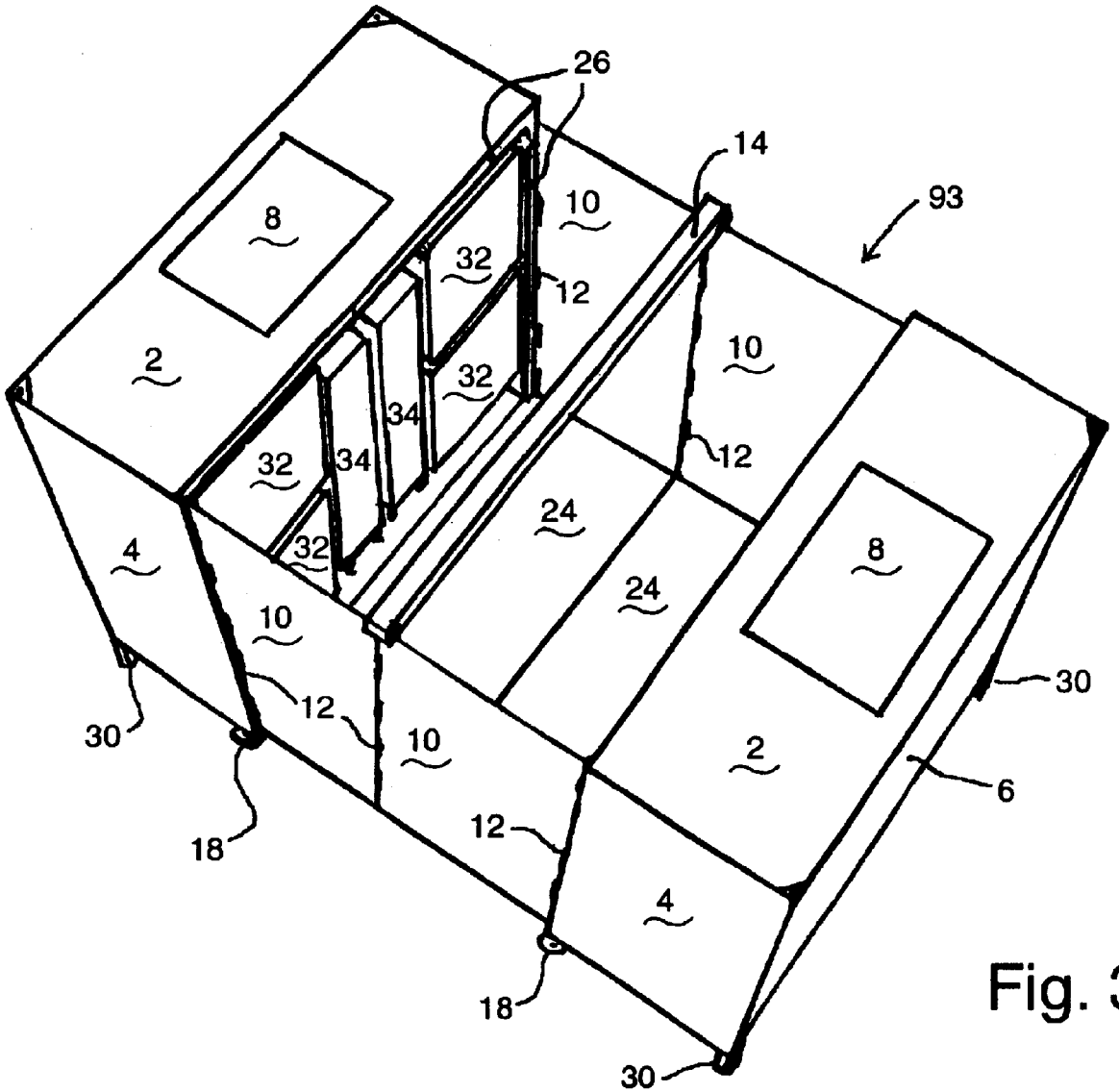

FIG. 3C shows the module 93 with the space frames 26 fully extended and the side panels 10 fully unfolded and locked in place at the ends of floating beam 14. Retractable leveling jacks 30 have been extended at the ends of space frames 26 to support and level the module in conjunction with adjustable wheels 18. The space frames are preferably constructed of large diameter aluminum extrusions which allow space to mount jacks at each vertical frame member, if desired, to distribute loads, particularly on soft ground. The jacks may be similar to the conventional ratchet or screw-type units such as are used for leveling recreational vehicles and the like.

Figure 3D:
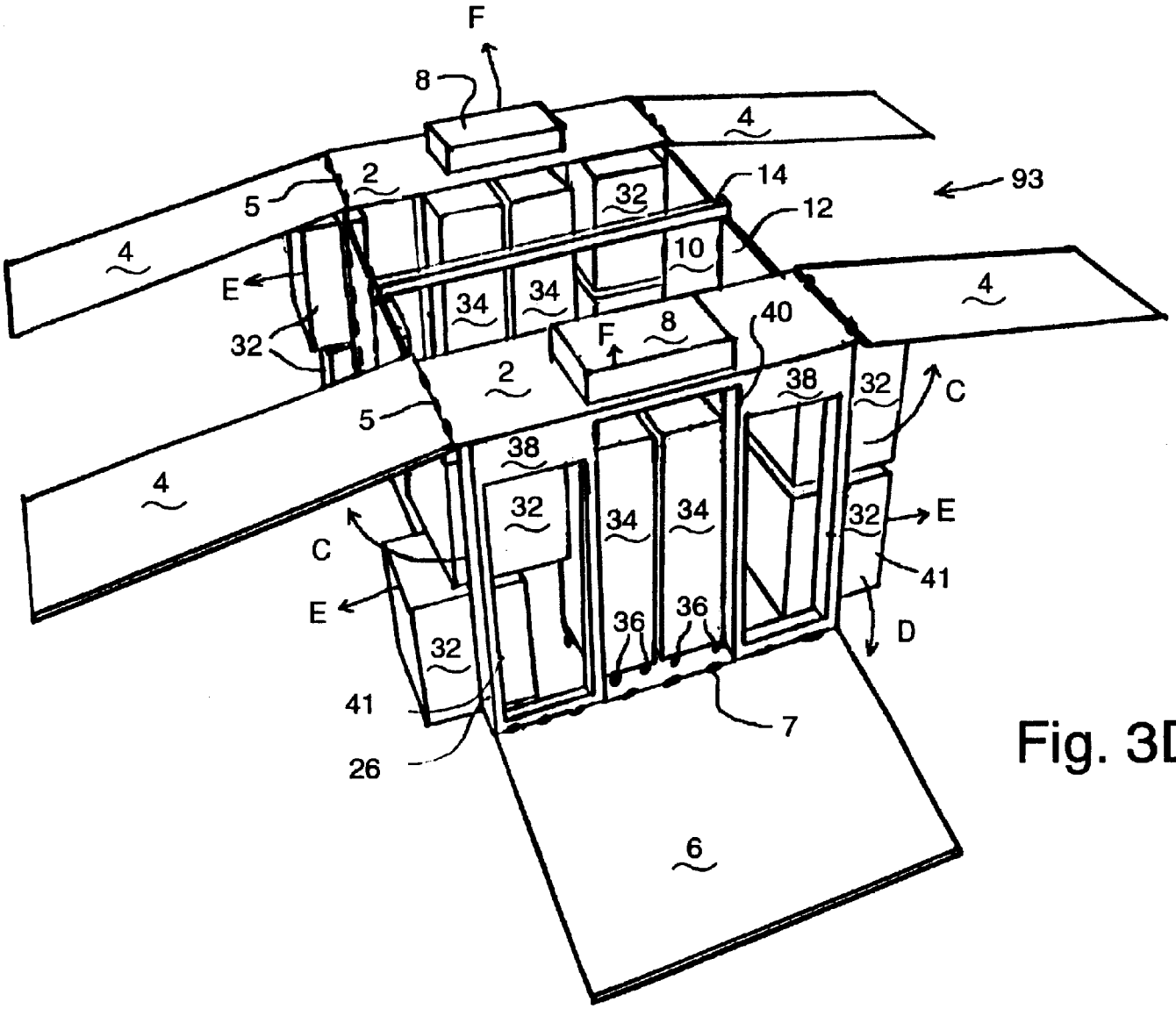

FIG. 3D shows the module 93 with the overhead wing panels 4 unfolded along wing hinge 5 in the direction of Arrow C. The entry/exit platform 6 has been unfolded along platform hinge 7 in the direction of Arrow D (an additional platform 6 is also unfolded on the hidden opposite side of the module). The hinge mechanisms 5, 7 are comparable to the side panel hinge 12 and are preferably continuous hinges but may be a plurality of discrete hinge components. The opening of the wing panels 4 exposes the plurality of slide-through cabinets 32, which are shown in various degrees of extension outwards in the direction of Arrows E. The HVAC units 8 have also been extended upwards in the direction of Arrows F. The moveable cabinets 34 remain in the stored position blocking the module doorways 40. The end panels 38 containing openings 41 to receive the movable cabinets 34. As can be seen, the outward extension on the slide through cabinets 32 clears the communication of open 41 to the operating room interior to permit double-sided access to the moveable cabinets 34 when deployed by means of the lockable or retractable casters 36.

Figure 3E:
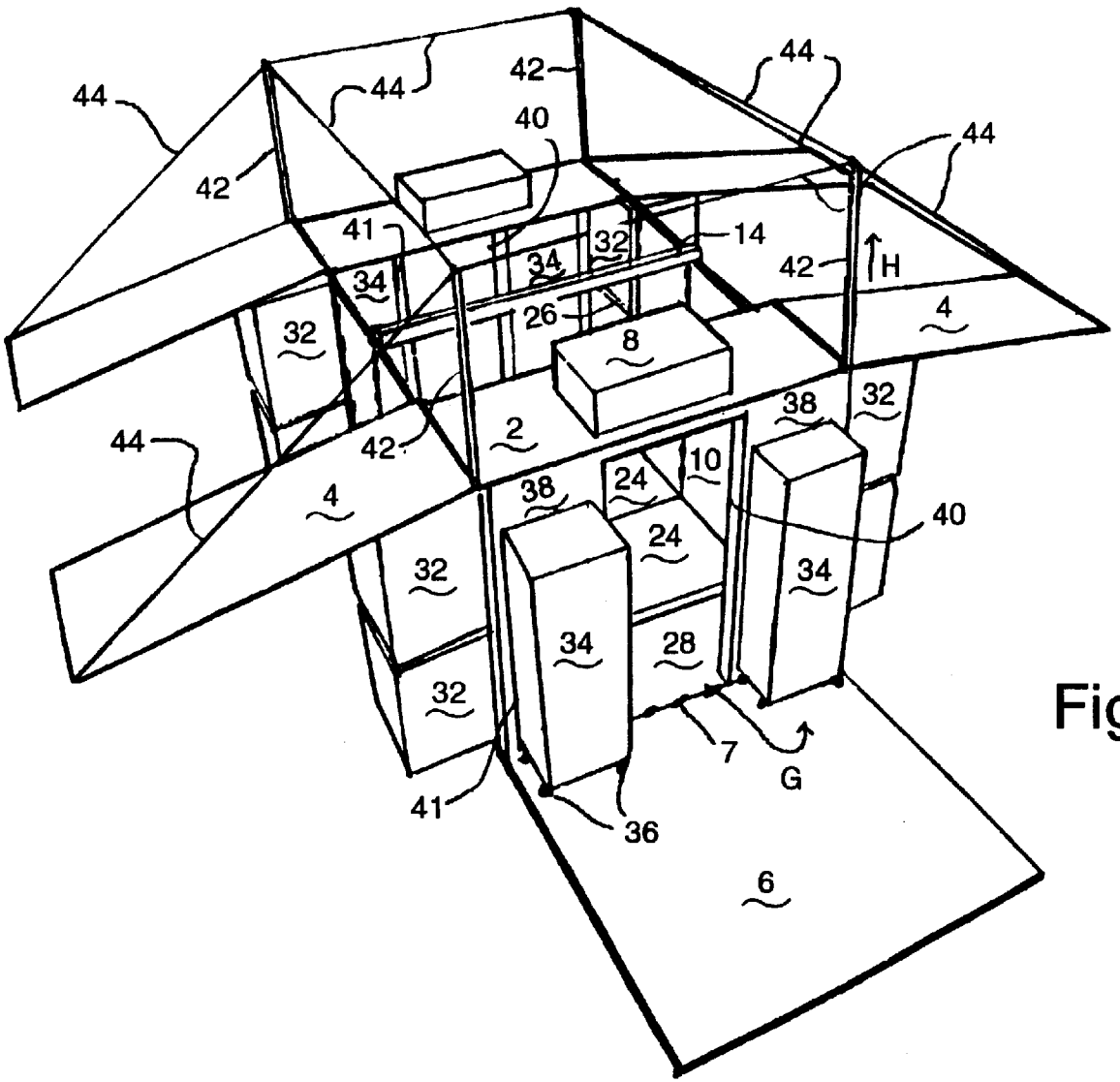

FIG. 3E shows the module 93 with the movable cabinets 34 deployed to mate with end panel openings 41 along the path shown by Arrow G, thereby clearing the doorway 40. The castors 36 are then preferably locked or retracted to stabilize the placement of the movable cabinets 34. The slide through cabinets 32 are shown fully extended. As can be seen in the upper left of the figure the moveable cabinets 34 are thus exposed to the interior of the operating room through opening 41. Also the interior space of the space frames 26 is now empty of installed equipment, maximizing the usable floor space of the operating room. The operating table 87 (FIG. 1) is preferably movable and placed after module expansion. The extendible masts or struts 42 have been extended in the direction of Arrow H from their telescoped storage position within the space frame. The extension means may be similar to the means used for the leveling jacks 30, or alternatively the masts 42 may be removable elements deployed by placement in fittings or sockets on the module roof Guy wires or fiber cables 44 have been installed inter-connecting the tops of the masts 42 and connecting to the outer ends of wing panels 44 to fix and support the wing panels. The fittings to connect the guy wires 44 to the masts and other attachment points may be conventional fittings, eyes or brackets, and may include adjustable links or turnbuckles to adjust tension. The tenting is preferably integrally attached and stored tightly folded and protected under wing panels 44 and platform 6 when these elements are retracted in the module "container" configuration. The tenting is thus exposed as the panels are extended, but is not shown in FIGS. 3D, E for clarity. Alternatively, the tenting may be wholly or partly stored separately, and attached to the module during deployment.

Figure 3F:
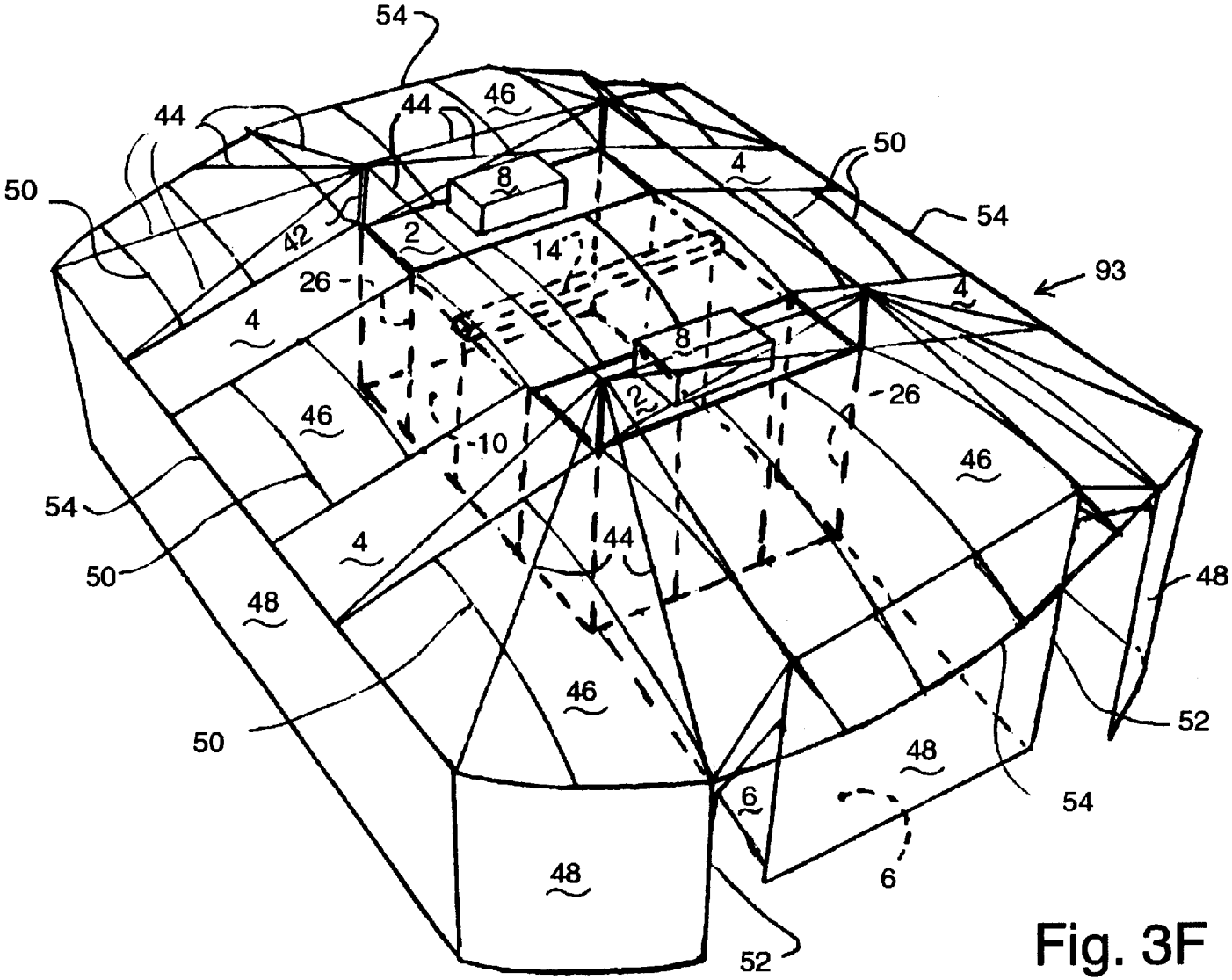

FIG. 3F shows the module 93 fully deployed as a suite with tented perimeter, and the hidden structure of space frames 26, side walls 10, entrance platform 6 and floating beam 14 shown as dashed lines. For each of the AZTEC embodiments, the tenting provides lightweight and compact protection that can be contained within the collapsible unit as delivered, to be easily deployed and available at all times. The tenting skin may be constructed of heavy duty rip-stop nylon and utilizes technology developed for racing sails. The combination of tension, suspension and stressed, sail-like ceilings allow for head room, lower profile, completely open floor space and better climatic control as well as good light diffusion for uniform interior illumination. Controlled curvature of the tenting segments controls the overall shape and minimizes the lift or flapping. The tenting roof or ceiling 46 and a plurality of curved rib battens 50 are deployed in position and fixed, supporting the tent roof 46 and perimeter tent wall 48. The ribs 50 in the central portion of the deployed suite attach at each end to the wing panels 4 and the roof panels 2, and are rigid enough to support roof loads. The ribs at each end of the deployed suite attach at only one end to the wing panels 4 and the roof panels 2 Additional guy wires 44 are deployed from the masts to the outward end of certain of the ribs to support the tenting perimeter ends. Tent edge rod 54 provides continuous perimeter support to the tenting and supports the perimeter wall 48. The edge rod 54 has sufficient rigidity to support the ends of those ribs not directly supported by guy wires, The edge rod and ribs may extend beyond the roof skin and/or perimeter walls, to maintain the perimeter shape in the region of the exterior doorways 52 or to provide rain protection at the doorways.

The guy wire/mast bracing and strength of the overhead wing panels may be sized and arranged to accommodate the weight of deployment personnel to provide walkway roof access for the purpose of maintaining the HVAC units and applying, removing and maintaining any roof supported sandbags for ballistic protection. The tenting may also include additional membrane-type airlocks adjacent to the entry/exit platform. The tenting may include internal partitions to divide the perimeter areas between post-op, triage, or storage spaces. Special climactic adaptation and ballistic protection may be provided in separate kits carried in the supply module 95 for requirements unique to particular extreme conditions such as tarps for heavy rain or cold weather insulation.

The tenting support structure shown provides basic support to the tenting without the necessity of additional ground-fixed poles, stakes, ballast or stays in order to permit site flexible rapid deployment and minimum time to first surgical procedure. The perimeter wall of the tent provides for flexible tie-down systems, such as guy-wires or ropes, stakes, and the like, and such additional supports and ground fixtures may be optionally used or deployed as time permits, and may be used in storm or high wind conditions.

Following deployment of the basic suite structure, the operating table, triage and post-op beds and power/utility/communication connections (not shown) to the power and utility module 96 and supply/communication module 95 are completed. The first procedure can start while the external tenting and triage area are still under deployment. For use in a rapid response mode as a single operating room module, the AZ1 module preferably has internal battery, water and utility storage to permit the first treatment procedures to begin while deployment crew completes the deployment of the support modules, and in military use, additional ballistic hardening such as sandbags.

FIGS. 4A, 4B and 4C show an overview of an AZTEC-2 operating/post-op module 97 as deployed. FIG. 4A shows the floorplan of the deployed AZ-2 module 93 and FIG. 4B shows a cross-sectional view of the same module from line 4B of FIG. 4A. Detail drawing FIG. 4C shows an elevation of the central equipment bay 60 and central passageway 68 of the AZ2 module viewed from line 4C of FIG. 4A. The AZ2 is shown illustrating one patient on operating table 87 in the operating room 91 at the right side of FIG. 4A, and with two patients on tables 87 in the post-op room 90 at the left side of FIG. 4A. Additional patients are shown in beds or cots 89 in the triage/post-op perimeter areas 98. Between the operating room 91 and the post-op room 90 lies the central equipment bay 60 and central passage way 68.

The AZ2 module is designed around a central foundation chassis 64 (FIG. 4B) which supports two end spaceframes or cages 67, shown on the right and left side of the figure, on a system of cantilevered beams (see FIG. 8) that are housed within the chassis 64 to create the interior volume when extended. The chassis 64 directly supports central space frame 66, which houses the central equipment bay 60 and central passageway 68. Pairs of hinged sidewalls 10 link both end spaceframes 67 which unfolded along hinges 12 during the extension of the end spaceframes from the chassis in deployment of the module to enclose the operating room 91 and post-op room 90.

A plurality of double access slide through cabinets 32 for supplies and/or medical equipment line the wall of the end space frames 67, and are extended upon deployment in the same manner as described above with respect to the AZ1 module. The cabinets are accessible from both the outside and inside of the operating or post-op room but do not intrude into the usable floor space of the room, and allow for resupply of the operating room without interference with surgical procedures while providing support for patients under the tented triage and post-op areas.

Doorway 74 opens through the side of the central space frame 66 to exit/entry platform 62. Membrane-type airlocks 88 are installed in the central passage way 68 and at the lateral margins of the platform 62 to control airflow to/from the triage/post-op areas 98, Air conditioning and filtration (HVAC) units 8 (FIG. 4B) are located on the top of the central cage 66 (FIG. 4C) and are shown in their extended position. Duplicate units as shown may be included for redundancy and increased capacity- Like the slide-through cabinets 32, the HVAC unit 8 is extended outward from within the cage during deployment to create additional usable space or headroom within central passageway. The HVAC unit functions in the same manner as described above with respect to the AZ1 embodiment.

The tenting structure of the AZ2 module is generally similar to that of the AZ1 module described above, but differs in certain respects. As the floating beam 14 (FIG. 1B) of the AZ1 is omitted in the AZ2, metal halide lamps 15 are mounted facing upwards on the central or end space frames 66, 67 to reflect and diffuse from the coating material on the inside of the tent roof skin 46 which covers the operating room and post-op rooms 91, 92. As with the AZ1, the tenting covering the perimeter areas comprises the tent roof skin 46 and the perimeter curtain wall 48, supported by rib battens 50 and by guy wires or lines 44 mounted to extendible masts or struts 42. The AZ2 has masts located on the central frame 66 as well as the end frames 67. In addition, the AZ2 has a pair of center overhead wing panels 72 in addition to end frame wing panels 70, providing additional tenting support (see FIG. 6). Doorway membranes or closures 53 retractably close the external doorways 52 to the perimeter areas, As with the AZ1, there is no built-in or integral flooring in the perimeter areas, although optionally tarps, floor panels or other tent flooring can be incorporated. Likewise, for military requirements, small arms and fragment hardening can be achieved by incorporating a ballistic polymer fabric into the tenting, and by placement of protective sand bags covering the operating room roof.

FIG. 4C shows the arrangement of the components contained in the central cage or space frame 66. The storage and equipment shown is generally duplicated on the hidden opposite side, although the specific supplies and equipment will reflect the differing surgical and post-operative uses. On the right side is shown the sink and washing fixture 63 and the plurality of storage and equipment cabinets labeled collectively as 61. On the left side is the central passageway 68 containing airlock 88. The HVAC units 8 are shown in the upwardly extended position, clearing headroom in the central passageway.

FIG. 5 illustrates the configuration of the AZTEC 2 system in the fully retracted storage/transport "container" configuration in the cargo bay of a C-130 aircraft in a manner generally comparable to that shown in FIG. 2 with respect to the AZTEC 1 system. The AZTEC-2 main container is twice the size of that of the AZTEC-1 and includes both the OR and Post-Op areas in the same envelope. In this system, there are four modules: two AZ2 operating/post-op suite modules 97, each of which is 13'4" long, 8'6" wide, and 8'6" high in its storage/transport "container" configuration; one supply and communications module 95; and one smaller power and utilities module 96. The supply and power modules may be essentially the same as described above with respect to the AZ1. The AZ-2 provides larger and more integrated Operating and Post-Op spaces, provides a more unitized and comfortable operating environments, but is somewhat less flexible and cannot be transported by the lighter helicopters as with the AZ-1. However, the AZ2 modules may be conveniently transported by conventional road vehicles from a forward airfield to a remote deployment site, if desired.

FIGS. 6A through 6G show an AZTEC-2 operating/post-op suite module 97 through the deployment sequence following site delivery. The figures are perspective views sharing approximately the same perspective of the module, although the particular angle of view varies somewhat from figure to figure, and features common to the various figures should be noted as a frame of reference. Various elements which appear in several figures may be labeled in each figure to provide such a continuing visual frame of reference, but may not be separately described in each in order to avoid excessive redundancy.

Figure 6A:
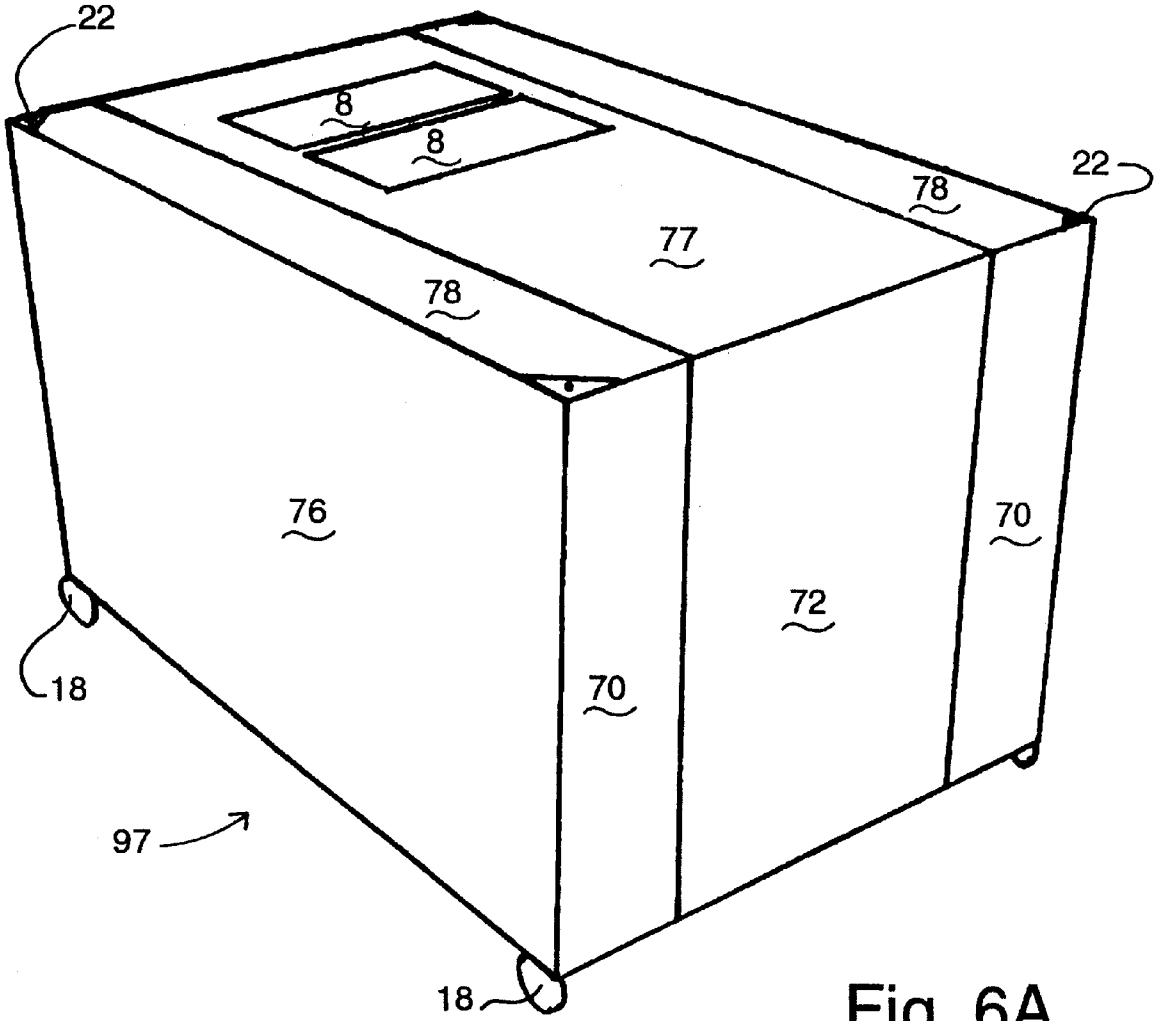
FIGS. 6A through 6G show the sequential step-by step transformation of an AZ2 module from the storage/transport configuration to a fully deployed operating/post-op suite.

FIG. 6A shows the module 97 as delivered on the site. The module contains integral recessed sling attachment points or hooks 22 at the upper corners for helicopter transport. The module location is adjusted in the same manner as described above for the AZ1, and is moveable on retractable/adjustable wheels 18. Following site placement, the module is leveled using the level adjustments of the wheels. In the compact transport "container" configuration, certain of the module components are visible at the surface and form the protective enclosure of the container. The center wing panel 72 and the end wing panels 70 are folded down vertically to form the container side. The end roof panels 78, center roof panels 77 and the tops of the retracted HVAC units 8 form the top of the container. The ends of the internally folded side panels 10 and side panel hinges 12 (FIG. 6B) are recessed within the cage structure during storage and are not seen. The hidden bottom of the container is the expandable chassis 64 resting on the retractable/adjustable wheels 18. A retractable or removable tow bar may be installed (not shown). In this configuration, most of the internal volume of the container consists of the space frames or cages 66, 67 (FIG. 6B). The end cover 76 seals the outside faces of the side-through cabinets during storage, and also protects folded tenting structure.

Figure 9:
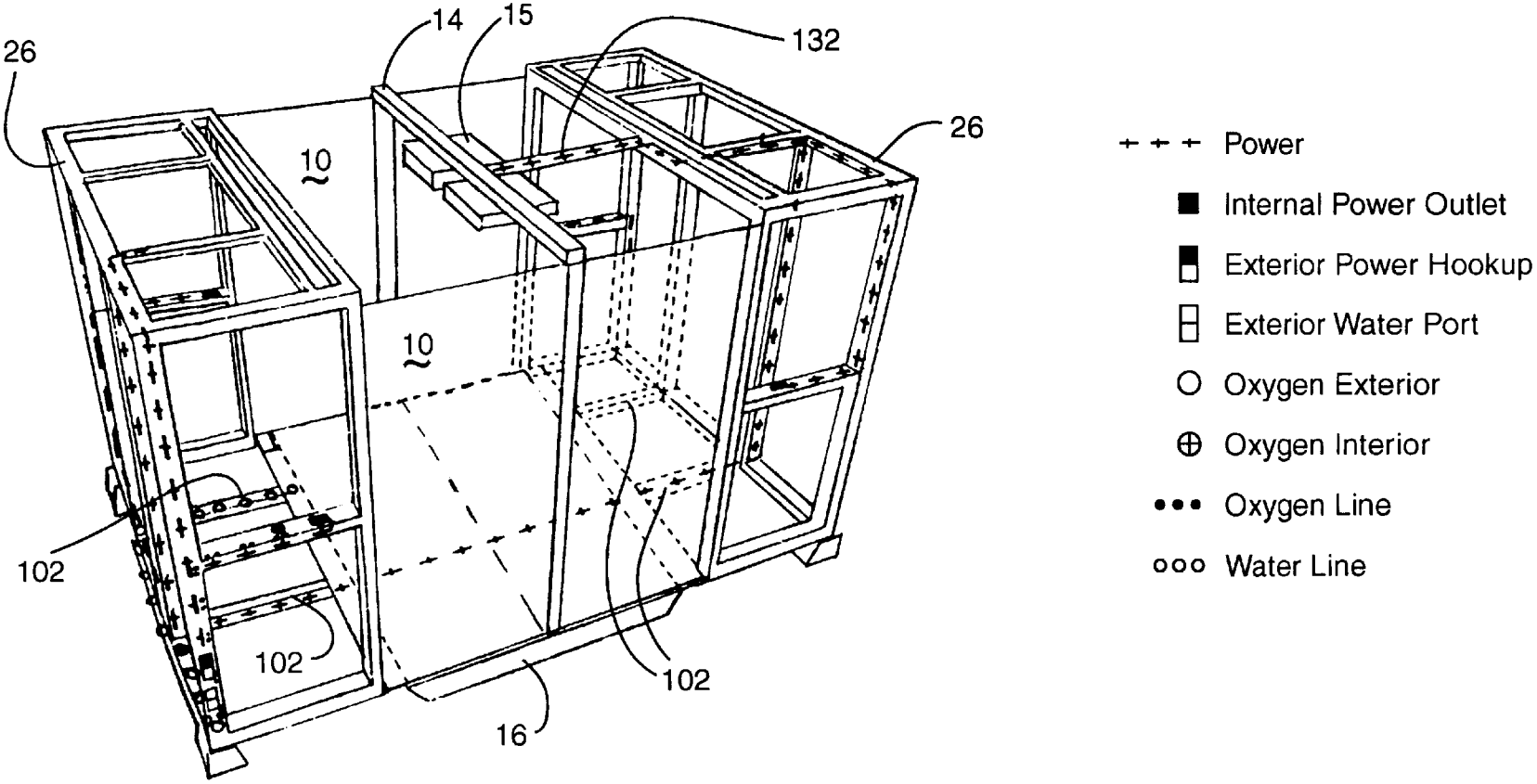
FIG. 9 is a view of the expanded chassis and space frame structure of the AZTEC 1 system showing the water, oxygen and power utility line layout.

FIG. 6B shows the module 97 with the end space frames 26 partially extended in the direction shown by Arrows I on the telescoping beams 69 contained within chassis 17 (see FIG. 9). The side panels 10 have partially unfolded along three sets of side panel hinges 12 in the direction shown by Arrows J. The force to accomplish extension may be applied in the manner describe above with respect to the AZ1 embodiment. Each of the panel hinges 12 is preferably a continuous hinge incorporating weather seals, but may comprise a plurality of distinct hinge elements, or may be a flexible membrane or fabric hinge, or the like. The folding floor panel 65 folds down in the direction shown by Arrow K to cover the opening created by the extension of the end cages 67. It can be seen that the end cages 67 are nearly completely filled with retracted slide-through cabinets 32.

Figure 6C:
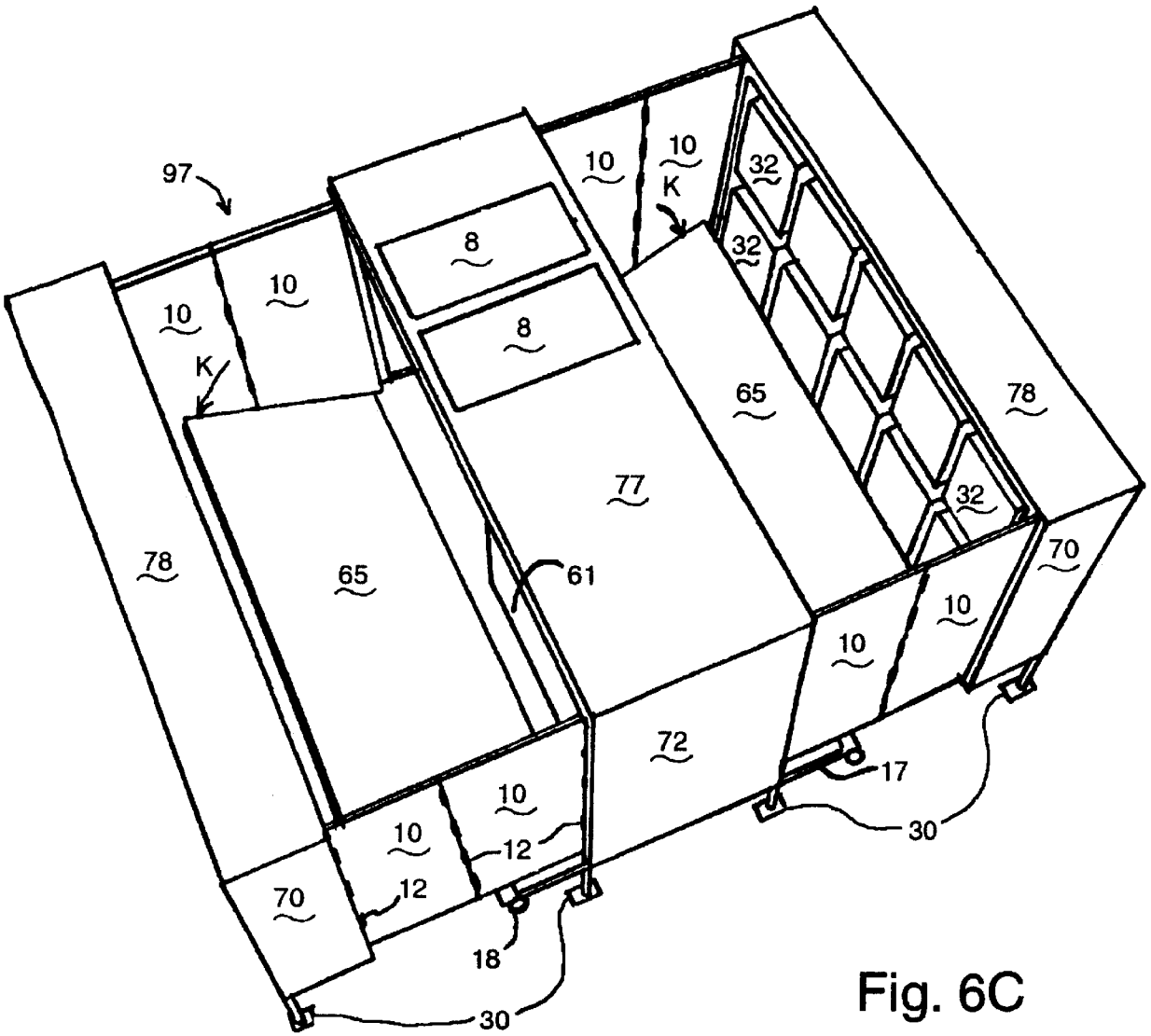

FIG. 6C shows the module 97 with the end cages or space frames 67 fully extended and the side panels 10 fully unfolded. The folding floor panel 65 is partially folded down in the direction shown by Arrow K. Retractable leveling jacks 30 have been extended at the ends of space frames 66 and 67 to support and level the module in conjunction with adjustable wheels 18. The jacks may be similar to the conventional ratchet or screw-type units such as are used for leveling recreational vehicles and the like.

Figure 6D:
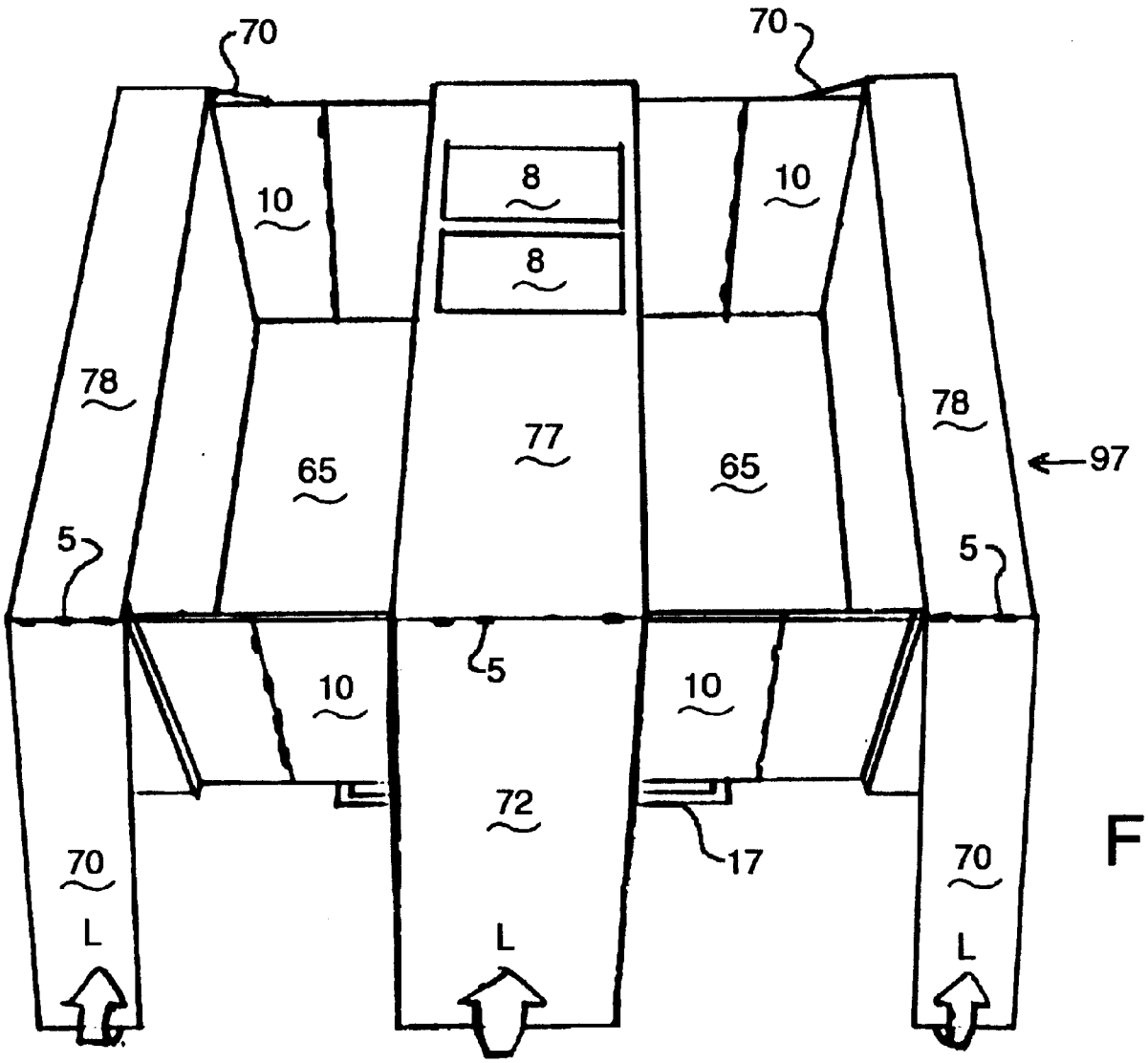

FIG. 6D shows the module 97 with the overhead wing panels 70 and 72 partially unfolded along wing hinge 5 in the direction of Arrow L. The entry/exit platform 6 has been unfolded along platform hinge 7 in the direction of Arrow D (an additional platform 6 is also unfolded on the hidden opposite side of the module).

Figure 6E:
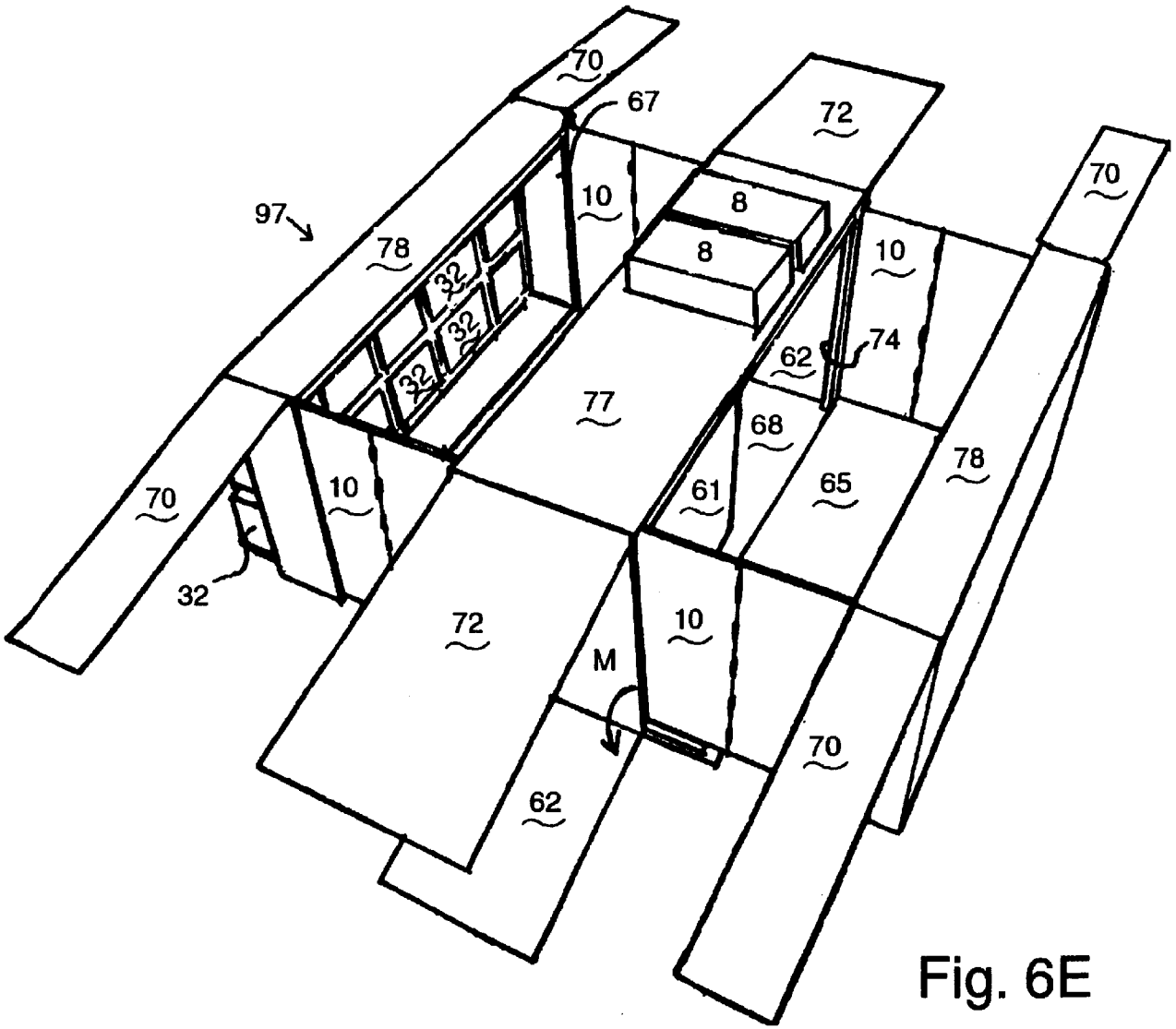

FIG. 6E shows the module 97 with overhead wing panels 70 and 72 fully unfolded on both front and back sides of the module, and with HVAC units 8 fully extended upwards. The front and back entry/exit/gangway platforms 62, which were stored folded up under the center wing panels 72, have been folded down in the direction of Arrow M. On the upper portion of the figure, doorway 74 has been exposed showing the deployed platform 62 in the background, which serves as an entry/exit ramp. In the lower portion of the figure the second platform 62 serves as a raised storage area, and may optionally be omitted. As can be seen on the right side of the figure, the outward extension of the slide-through cabinets 32 clears the interior space of the end cage 67 to maximize operating/post-op room floorspace.

Figure 6F:
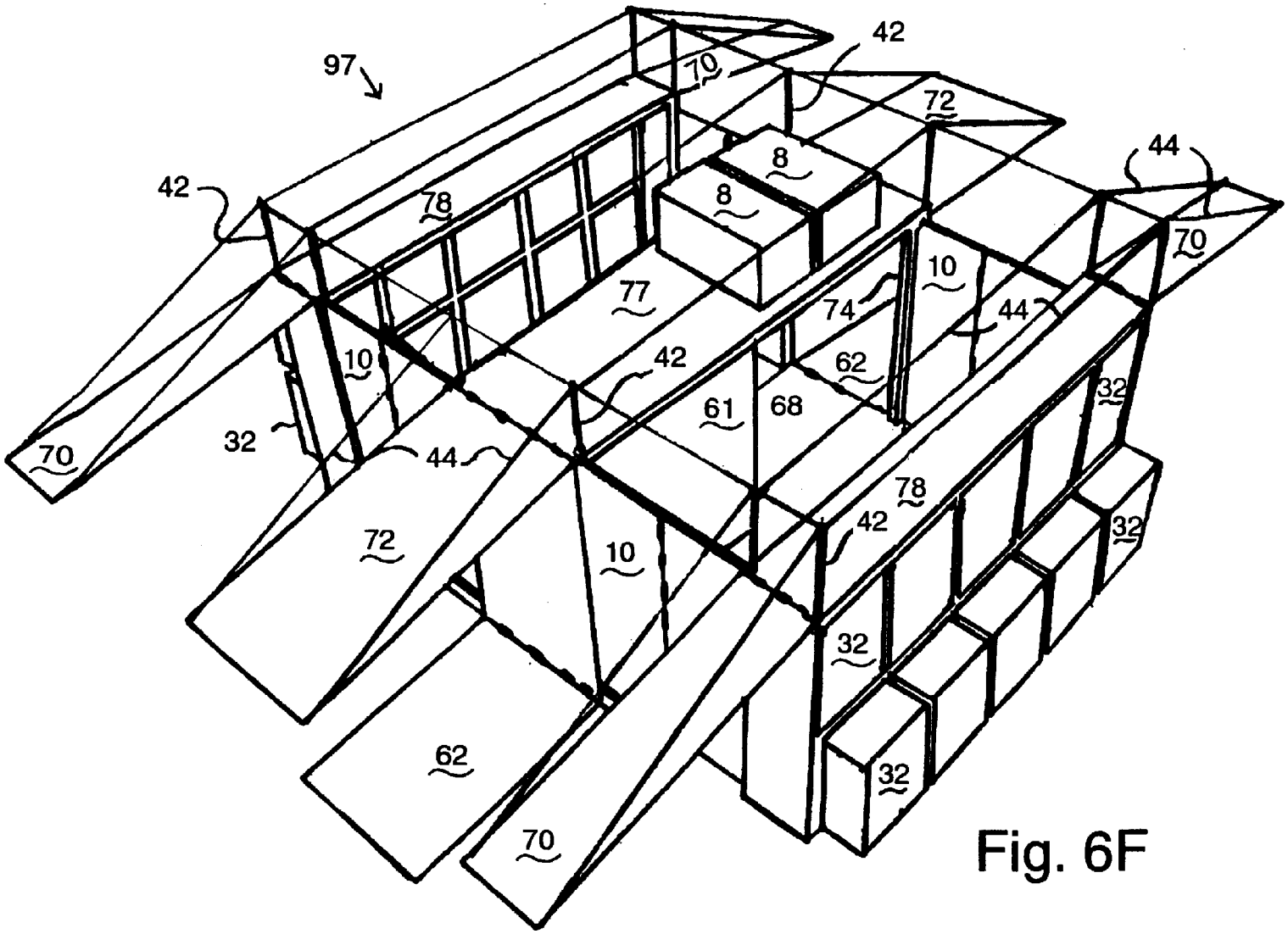

FIG. 6F shows the module 97 with the plurality of extendible masts or struts 42 extended up from their telescoped storage position within the space frames. Guy wires 44 have been installed inter-connecting the tops of the masts 42 and connecting to the outer ends of wing panels 44 to fix and support the wing panels. The masts, fittings and guy wires are similar to, but more numerous than, those described above with respect to the AZ1 embodiment. As with the AZ1 module, the tenting of the AZ2 is preferably integrally attached and stored tightly folded and protected under wing panels 72 and 70 when these elements are retracted. The tenting is thus exposed as the panels are extended, but is not shown in FIGS. 6F for clarity. Alternatively, the tenting may be wholly or partly stored separately, and attached to the module during deployment. The lower bank of slide-through cabinets 32 is shown fully extended at the lower left side of the figure, and the upper bank is not yet deployed.

Figure 6G:
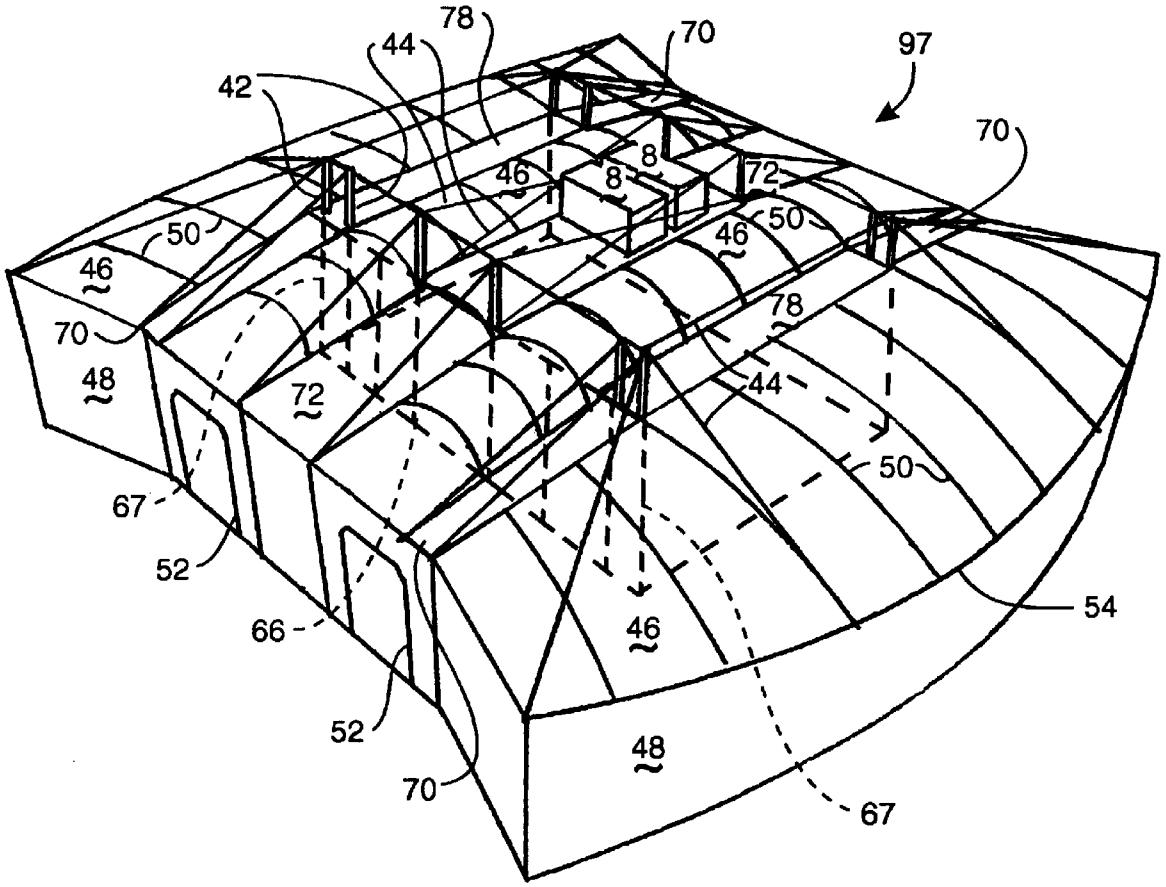

FIG. 6G shows the module 97 fully deployed as a suite with tented perimeter, and the hidden structure of the module including the central and end space frames 66 and 67 is shown as dashed lines as a frame of reference. The tenting structure is generally similar to that described above with respect to the AZ1 embodiment, except that the roof 46 covers a greater area and has a greater number of masts 42, guy wires 44 and ribs 50 as support. As with the AZ1, the rib battens 50 attach either to two wing panels 70, 72 or to an end wing panel 70 and the perimeter edge bar 54, which supports the perimeter tent wall 48. Exterior dooways 52 pass through the perimeter wall The tenting may also include additional membrane-type airlocks adjacent to the entry/exit platform., and internal partitions to divide the perimeter areas between post-op, triage, or storage spaces, such as a separate storage or personnel area behind the center space frame 66 on the side opposite from the entry/exit door 74.

As in the AZ1 embodiment described above, the tenting support structure shown provides basic support to the tenting without the necessity of additional ground-fixed poles, stakes, ballast or stays in order to permit site flexible rapid deployment although additional module mounted supports and ground fixtures may be optionally used or deployed as time permits, and may be used in storm or high wind conditions. Following deployment of the basic suite structure, the operating table, triage and post-op beds and power/utility/communication connections (not shown) to the power and utility module 96 and supply/communication module 95 are completed. The first procedure can start while the external tenting and triage area are still under deployment and while deployment crew completes the deployment of the support modules, and in military use, additional ballistic hardening such as sandbags.

FIG. 7 is a perspective view of the chassis framing and extensible telescoping floor beam system of the AZTEC 1 module, with the hidden structure shown as dashed lines. The plurality of telescoping beams 102 are shown partially extended from the chassis 16 and mount to and support the lateral space frames 26 (see FIG. 9) and comprise the principal module expansion element.

The structural framework of the chassis comprises a top skin plate 114 and a bottom skin plate 116 fastened or bonded at their perimeters to a pair of side members 108 and a pair of end members 110 to form a rigid hollow core box structure. A plurality of lateral frames 104 are spaced at intervals between the end members 110 to reinforce this structure and are fastened at each end to the inside of each side member 110 and are fastened or bonded to the top and bottom skins 114 116. Longitudinal frames span between the end members 110 and intersect the lateral frames 104 to form a rigid internal lattice.

Mounted on each side of the longitudinal frames are a plurality of beam rollers 106 forming a line of rollers on each side. On each side of each longitudinal frame 105 a channel section telescoping beam 102 engages the rollers 106 mounted on the frame 105, the rollers bearing on the upper inside surface of the channel to movably support the telescoping beam 102. The telescoping beams run parallel to the longitudinal frame and pass through cutouts 118 in the lateral frames 104 and through a cutout 118 in one of the end members 110. The telescoping beams are thus arranged in pairs about each longitudinal frame, with one of the pair of beams extending out through one end member 110, and the other beam of the pair extending out through the opposite end member. The cutouts 118 are sized to allow enough clearance from the beam 102 to allow telescoping motion, but prevent the beam from moving sideways to disengage the rollers. Thus a plurality of telescoping beams extend outward from each end member on each end of the chassis.

Wheels 18 mount to wheel brackets 112 which are rotatably and lockably mounted to the side members 108 at each corner of the chassis. The space within the chassis frame is preferably used for water tanks. A foam-filled polyurethane covered, sacrificial skid layer may be bonded to the underside of the bottom skin 116 to protect the chassis during transport, unloading and handling. The end members of the chassis may optionally house cable driven expansion winch mechanisms which pull on the opposite ends of the beams 102 to extend the beams. The expansion of the units may be accomplished by rechargeable power tools or manual cranks in order to eliminate fixed and heavy dedicated drive motors. At full expansion, the telescoping beams are supported by multiple rollers and a sufficient portion of the beam remains housed within the chassis framing to provide effective cantilever support of the space frames.

Figure 8:
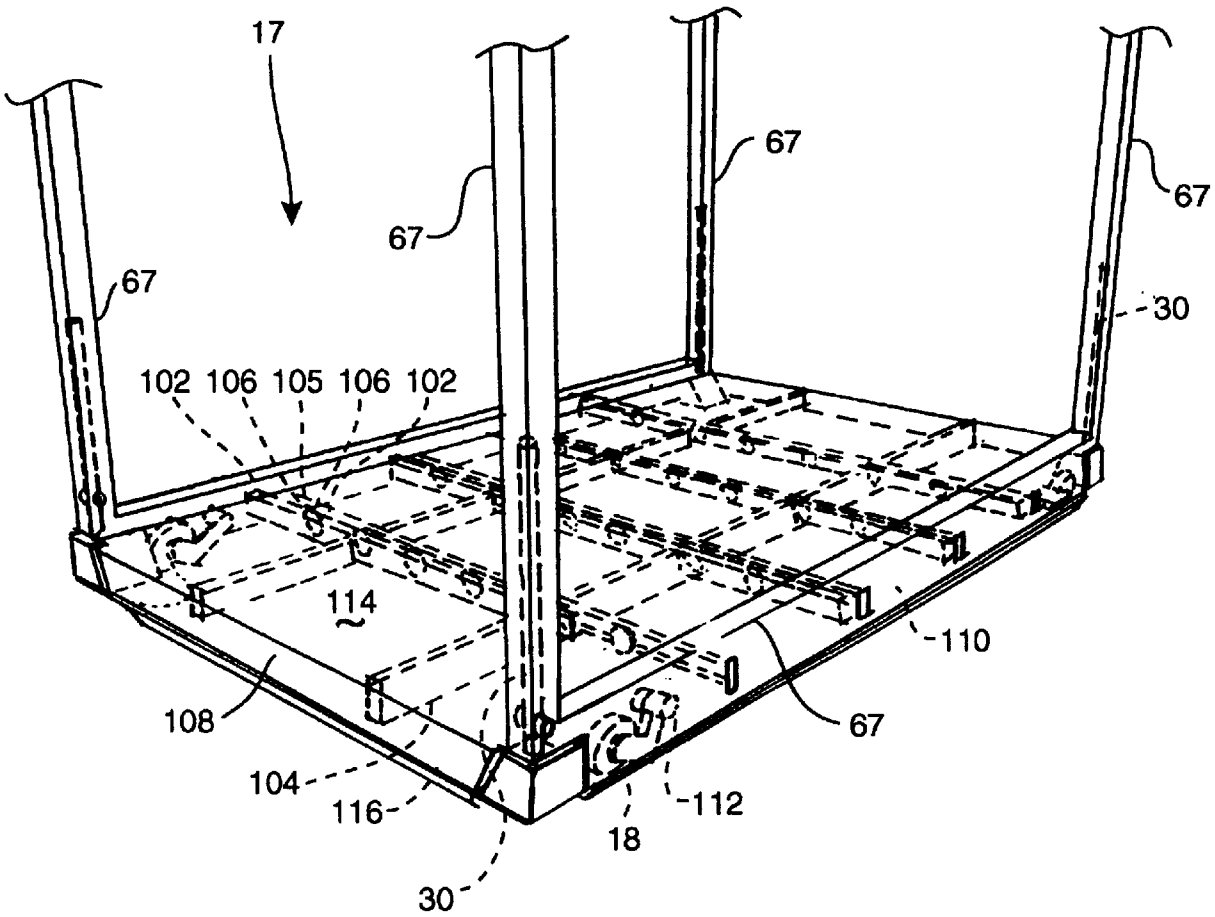

FIG. 8 is a perspective view of the chassis framing and extensible telescoping floor beam system of the AZTEC 2 module, with the hidden structure shown as dashed lines. The chassis is shown in its retracted position with the outer portion of the end space frames 67 mounted on the ends of the one of each pair of telescoping beams 102. The chassis framing and extensible telescoping floor beam system of the AZ2 is essentially the same as that of the AZ1 although it comprises a greater number of telescoping beams 102 and longitudinal frames 105 members due to its larger size and capacity. A rigid box structure is formed by top and bottom skins 114,116, end members 110, side members 108, and an internal lattice of lateral frames 104 and longitudinal frames 105. The beams 102 are supported by lines of rollers 106 mounted to frames 105 as in the AZ1 chassis. The wheels and wheel brackets 18 and 112 are shown mounted to the end members. Retractable leveling jacks 30 are shown house internally in the space frame members 67.

FIG. 9 is a view of the expanded chassis 16 and space frame structure 26 of the AZTEC 1 system showing the water, oxygen and power utility line layout, and this system also is generally applicable to the AZ2. The AZTEC system, in both configurations, utilizes exterior ports to supply both power and water. "Power and water supply lines pass though the cores of the tubular extrusions that make-up the cage structure." Oxygen lines from the oxygen concentrators can be developed as part of the infrastructure. Power harness is run from an exterior port located on the chassis to multiple points inside each unit. Power hookups dedicated to surgical tools are located above the OR table in the overhead lighting fixture. Infrastructure outlets for power, water, and oxygen are also located externally to serve the triage area. Water stored in interior reservoirs is located in the chassis of AZTEC-1 and in the chassis and central bay of AZTEC-2, is accessed from both the interior and exterior. Resupply of water tanks is achieved through exterior accessible chassis ports and piping that can be refilled without interruption of operation procedures. The telescoping beams 102 on each side of the chassis are extended to mount to the space frames 26. The space frames are shown without exterior paneling or floors to reveal the plurality of members, preferably aluminum extrusions, which comprise the spaceframes. The key contained in the FIG. 9 identifies the power, water and oxygen lines. The overhead lighting 15 is supplied by a flexible cable 132 which unfolds or extends as the side walls 10 unfold and the module is expanded. Flexible cables or tube may also be used to supply water or power to equipment located in the slide through cabinets 32 (FIG. 3)

Figure 10:
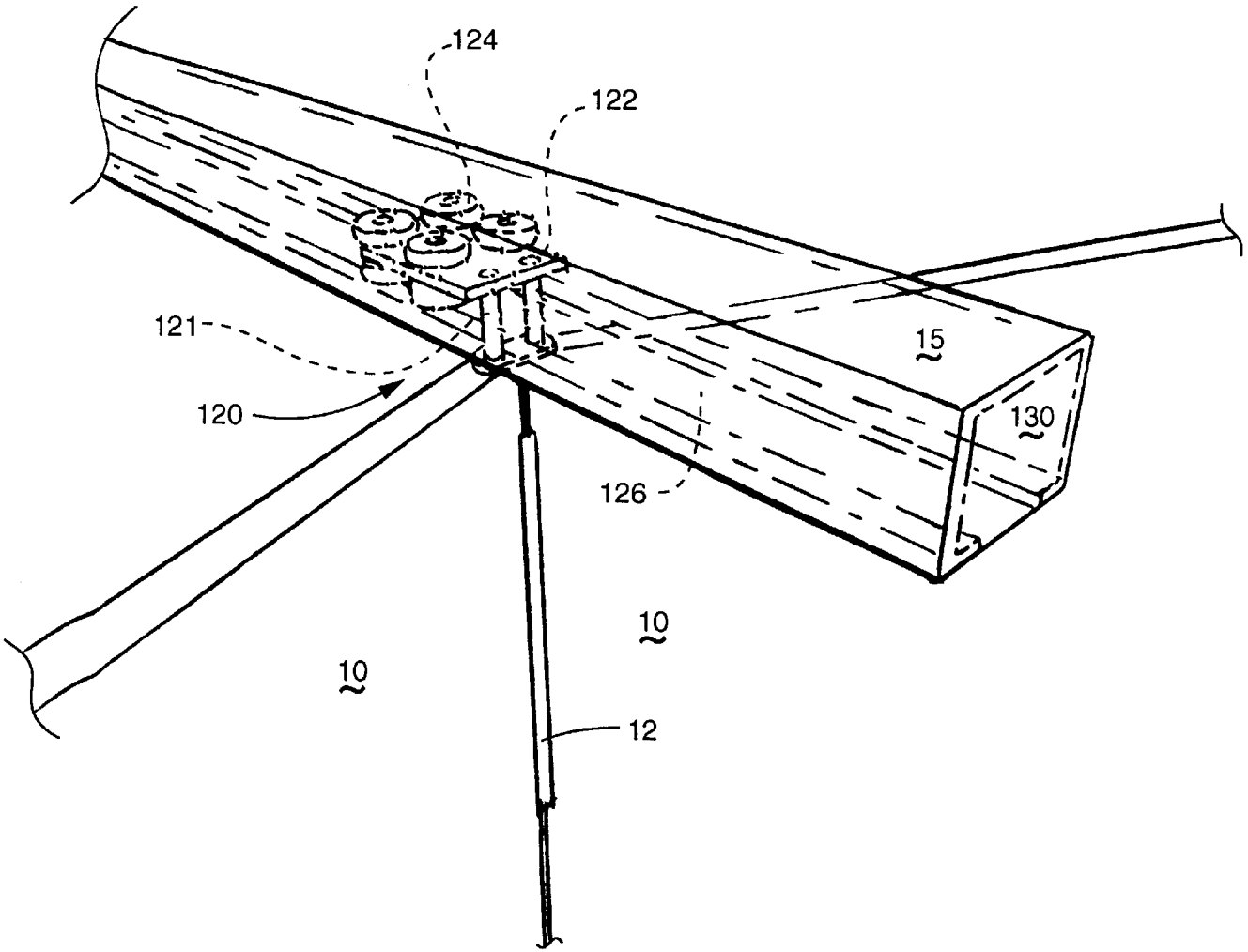
FIG. 10 is a view of the roller assembly engaging the floating beam with the folding side walls of the AZTEC 1 system.

FIG. 10 is a view of the roller assembly 120 engaging the floating beam 14 with the folding side panels 10 of the AZTEC 1 system. A mirror image roller assembly is located at the opposite side of the beam. The floating beam 14 is formed as a hollow member with an underside longitudinal slot 126 and end plates 130. The roller assembly 120 comprises a hinge end bracket 121, a roller mounting plate 122 and a plurality of rollers 124. The hinge end bracket 121 is mounted at the top junction of center hinge 12 of the pair of side panels 10, and is rotatably connected to the hinge so that it does not restrict the unfolding motion of the panels. The hinge end bracket extends upwardly through the underside slot 126. Roller mounting plate 122 in fixedly mounted horizontally to the top of the hinge end bracket within the interior space of the floating beam and has mounted upon it a plurality of rollers 124 arranged in a row on each side of the plate with their axis of rotation upwards. The width of the mounting plate and the diameter of the rollers are selected so that the rollers bear on the interior sides 128 of the beam, and fix the lateral location of the beam with respect to the hinge line. As the side panels 10 unfold, the roller assembly 120 is drawn outwards towards the end plate 30 of the beam. As the side panels 10 fully unfold, the roller assembly is stopped by the beam end plate 30, preventing the roller assembly from disengaging the slot.

Figure 11B:
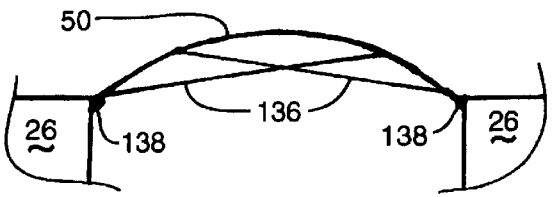
FIGS. 11A through 11D are detail views of the tenting support rib batten structure of the AZTEC 1 and 2 systems.
Figure 11C:
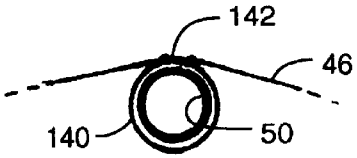
Figure 11D:
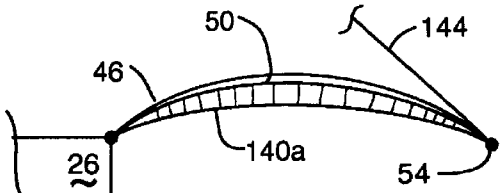
Figure 11A:
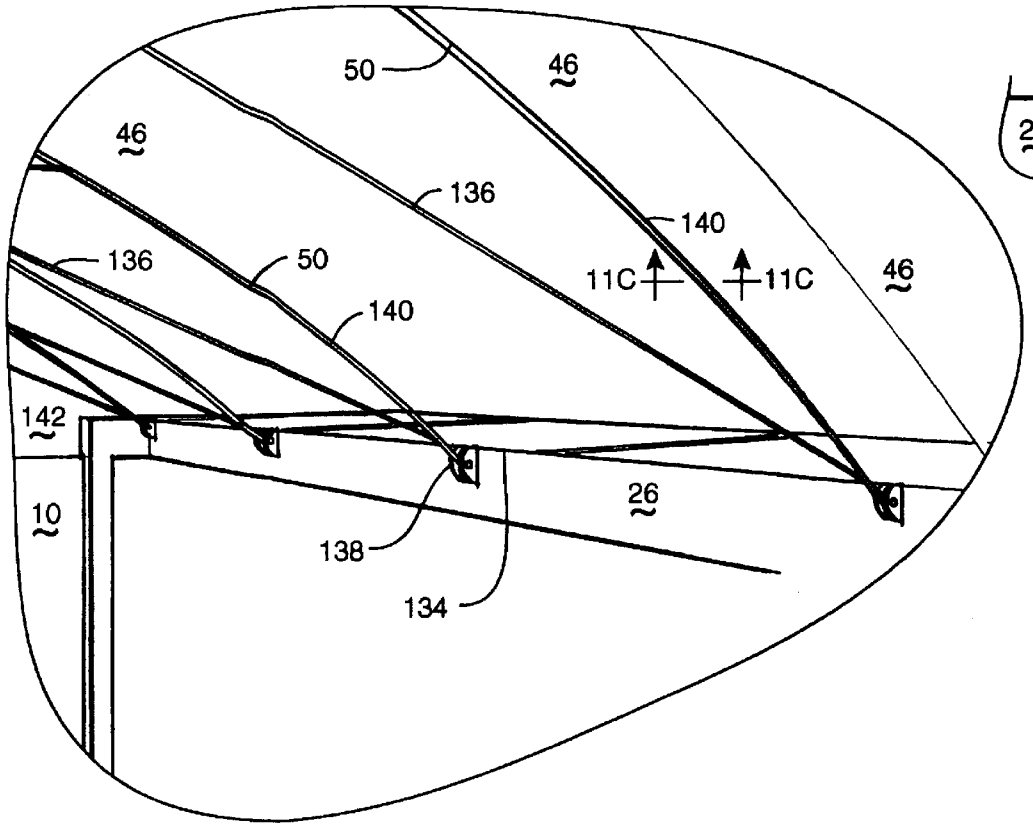

FIGS. 11A, 11B and 11C are detail views of the tenting support rib batten structure of the AZTEC 1 and 2 systems. FIG. 11A shows a perspective view of a portion of the tenting structure above the AZ1 operating room viewed looking upward and diagonally outward from within the room towards the corner of the space frame 26 adjacent the top of folding side panel 10. The rib battens 50 are mounted at each end to a rib bracket or ferule 138 which fixes the rib to the space frame 26 adjacent to inner edge 134. Side partition 142 joins the top edge of the side panel 10 with the tent roof skin 46 to provide an air seal between the operating room and the perimeter areas.

Rib stays 136 join points along the rib arc by being fixed to the rib and/or the rib sleeve (FIG. 11C) by ties, fittings or bonding, the length of the stay being selected or adjusted to place it in tension. As best seen in FIG. 11B, a plurality of stays 138 may be mounted on a single rib dividing the arc of the rib 50 into several shorter sub-arcs. This increases the buckling strength of the rib and increases its weight bearing capacity. Although the rib stays may be used throughout the tent roof structure of the AZ1 or AZ2, they are particularly useful in the tenting over the operating and post-op rooms if ballistic hardening with a distributed sandbag layer is desired.

FIG. 11C is a cross section of the rib and sleeve structure along Line 11C in FIG. 11A, showing the rib 50 encased in rib sleeve 140 which is continuously bonded or sewn along its length to the tent roof skin 46 at sleeve junction 142. The sleeve prevents sideward buckling of the rib. The rib or batten may be circular as shown, or may be flattened in section as in a typical sail-type batten, for more convenient pre-deployment storage and to prevent sidways buckling.

FIG. 11D shows a view comparable to that shown in FIG. 11B, but typifying the tenting structure in the perimeter tenting areas. The rib 50 spans between the outer edge of the spaceframe 26 (or wing panel) and the edge rod 54. The rib is encased in sleeve 140*a* with is attached along its length to tent roof 46 However, in this case, the sleeve is much broader than the rib cross section, and extends substantially below the rib to form a continuous web. The rib is constructed to be somewhat longer than the length of the sleeve, and thus the sleeve forces the rib into a curved shape, much as a bow string causes a bow to take a curved shape. The sleeve is held in tension while the rib remains in compression, the extended web of the sleeve thus functioning in a manner comparable to the system of stays 136 shown in FIG. 11B. The rib-sleeve assembly is shown supported at its distal end by guy wire 44, although not every rib is so supported, since the edge rod 54 provides lateral support and load distribution.

Figure 12A:
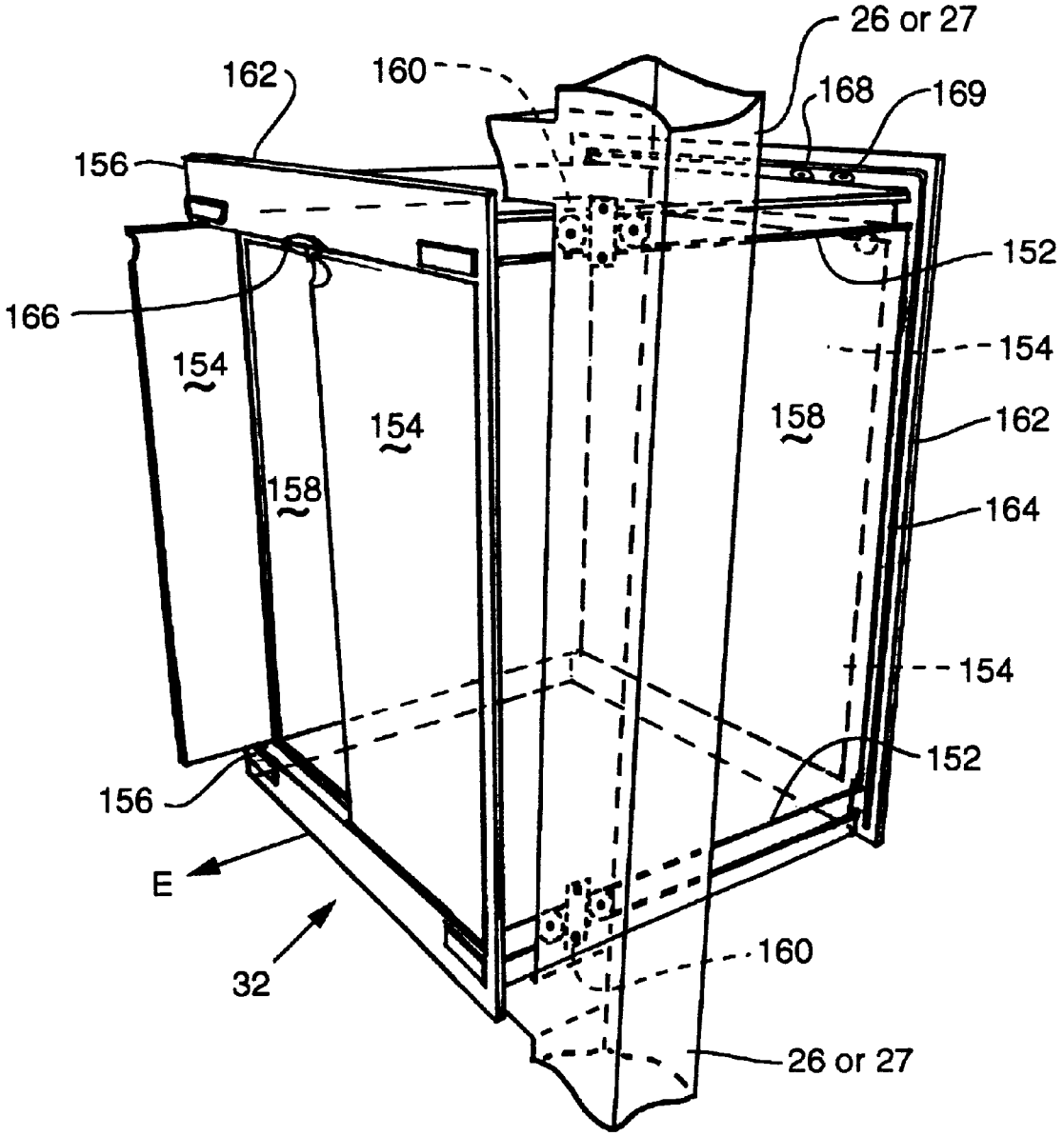
FIGS. 12A, 12B and 12C show the structure of the double access cabinets of the AZTEC system, FIG. 12 A showing the slide-through cabinet, and FIG. 12 B & C showing the movable castor mounted cabinet.
Figure 12B:
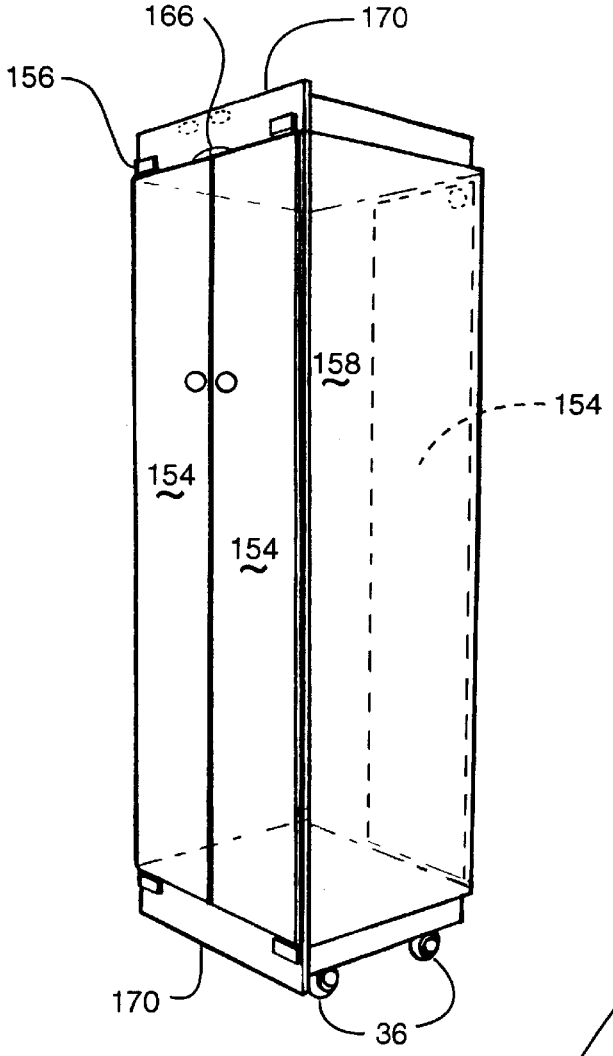
Figure 12C:
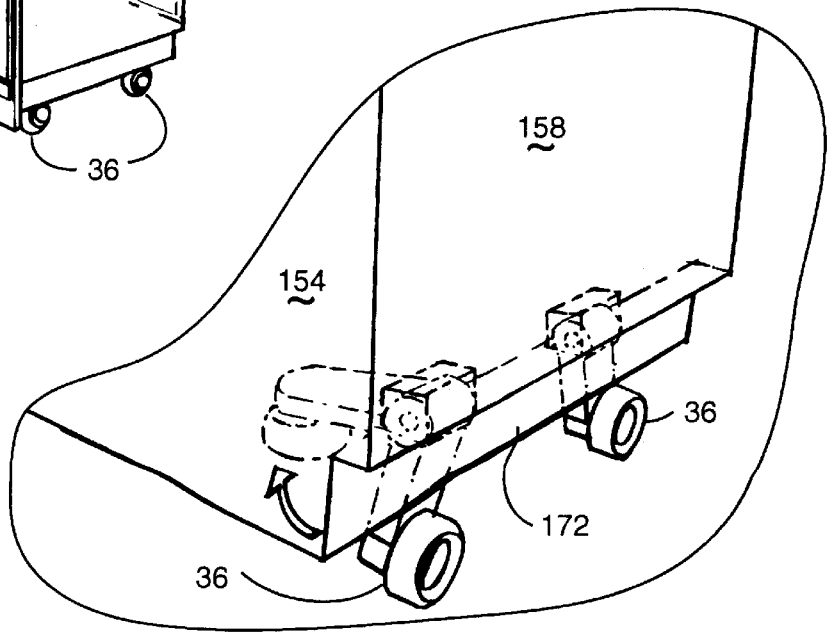

FIGS. 12A through 12C show details of the double-access cabinet system which surrounds the perimeter of the operating and post-op rooms to provide equipment and supplies, supplemented by the center space frame equipment storage in the case of the AZ2. The AZTEC system contains two types of double-access cabinets: the slide-through cabinets and the castor movable cabinets. For military requirements, either type may incorporate ballistic protection in its structure, to supplement ballistic structure of side panels and tenting.

FIG. 12A shows the spaceframe mounted, slide-through cabinet common in essentially the same structural form to both the AZ1 and AZ2 embodiments (see FIGS. 3E and 6F), illustrated with a cut-away portion of the spaceframe on which it is mounted. The cabinet can be configured to house either equipment or supplies, and is preferably standardized in size. "On each side 158 of the cabinet 32 is a pair of integral support rails 152 which are channel section members mounted horizontally to the top and bottom of the cabinet side wall 158 and are inset into the side wall 158 so that the channel opens laterally outward to engage roller assemblies or roller trucks 160 mounted on the vertical spaceframe members 26." There is a second pair of rails and roller assemblies on the opposite side of the cabinet. As the cabinet is extended forward and rolls on the roller assemblies in the direction of Arrow E, the cabinet flange 162 comes into contact with the spaceframe 26 (or 67 in the AZ2), compressing seal 164 and stopping further motion. A latch locks the cabinet in position against the space frame, although in use the positive air pressure of the internal rooms will tend hold the cabinet in the extended position.

A power plug 168 and communications or L.A.N. plug 169 may be positioned on the flange so that they are automatically engaged by flange contact to corresponding mating plugs on the spaceframe, to effect automatic hook-up for electrical, diagnostic or communications equipment in the cabinet. A similar arrangement is optional for water or oxygen connectors, or alternatively flexible coiled or folding cables and tubes may be used to maintain connections during cabinet movement. Double tops and bottoms may be fitted to the cabinet to house the lighting, locking mechanism, power connections and other hook-ups separately from supplies or other contents.

Cabinet doors 154 are pivotally mounted on door hinges 156. The hinges are preferably of the conventional disengaging pivot type and the cabinet side walls 158 of the double sided pocket type to permit the door to be telescoped and housed within the side wall after opening to approximately a 90 degree angle, particularly to permit unencumbered working space within the operating room. The doors may be of transparent plastic, to allow the contents to be visible when closed. Both inside and outside sets of doors preferably include electro-mechanical door lock mechanisms 166 with integral closure detectors, linked by logic circuitry (preferably as an integral unit) which analyses the state of the opposite door and permits the door to open only if the state of the opposite door is "closed". Alternatively, an entirely mechanical interlock means can serve this function. "This ensures that only one set of doors may be unlocked and opened at a time, in order to prevent operating room internal pressure release and to prevent contaminating backflow of air into the operating room due to loss of positive internal pressure in the operating room". The cabinet may also include internal openable membrane partitions for this purpose.

FIG. 12B shows the wheel or castor mounted, movable cabinet 32 employed in the AZ1 mated into openings 44 in the end panels 38 of the space frames 26 on each side of the entry/exit doorway 40 (see FIG. 3E). The cabinet 34 is moved from its storage position within the spaceframe upon deployment on folding or telescoping casters 36 which in their extended position bear on the floor. The structural arrangement of the doors 154, hinges 156, double sided pocket walls 158, and door interlock/detector 166 is essentially the same as for the slide-though cabinets 32 (see FIG. 12A) except the differing size and height of the movable cabinet 34. Upon deployment, front flange 170 sealingly mates with the edge of the opening in the space frame, to retain operating room pressure. The retraction of the wheels 36 leaves the cabinet effectively fixed in position, although a simple latch means may be used to fix the cabinet to the spaceframe. FIG. 12C shows a detailed view of the rollers 36 both in the upper collapsed position, and downward in the deployed position. The rollers are mounted on the bottom frame 172, a pair at each corner.

Figure 13:
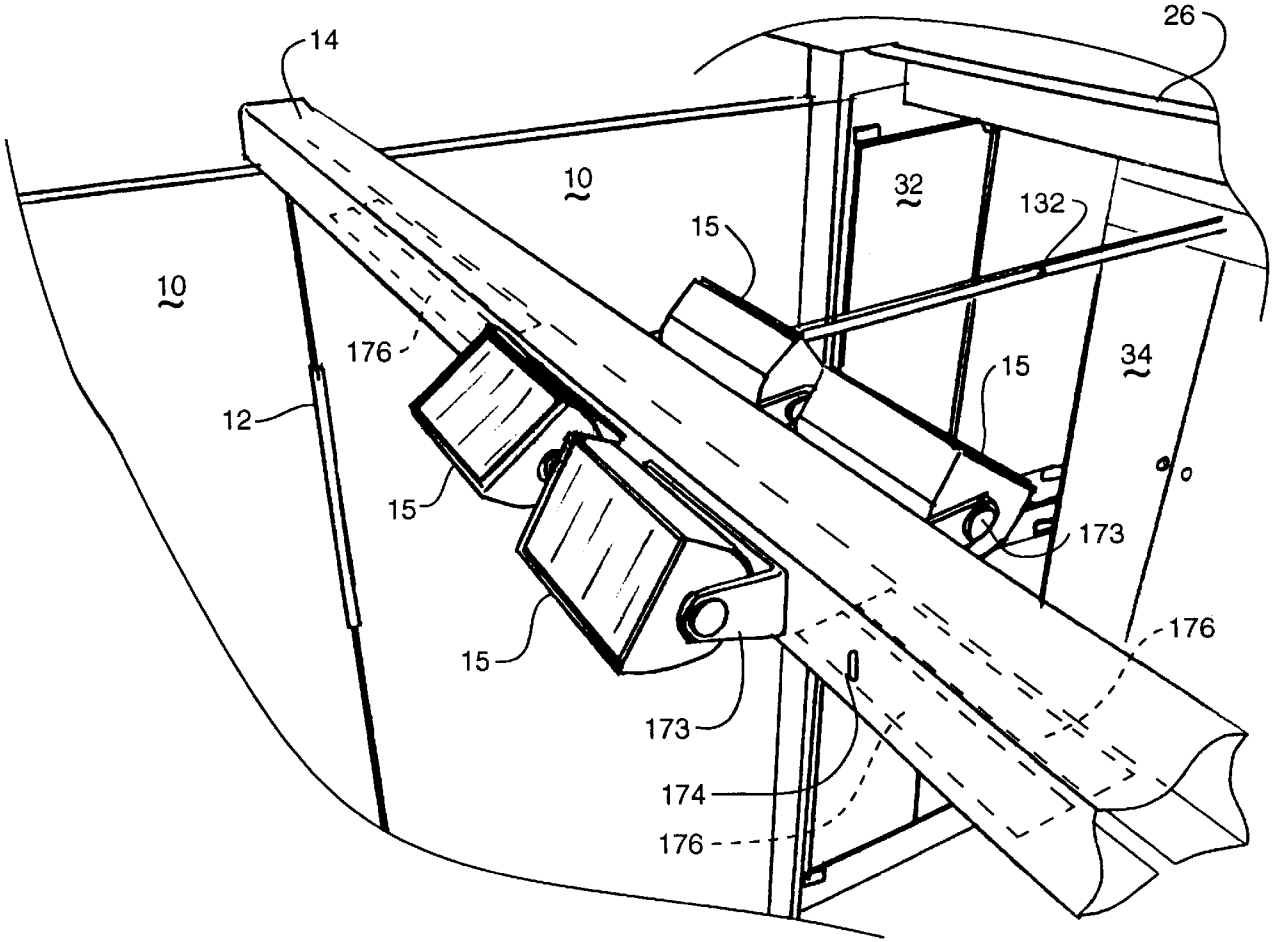
FIGS. 13 shows the operating room lighting fixtures and backup lighting system.

FIG. 13 shows the lighting system installed in the operating room or the AZ1 mounted on the floating beam. Essentially the same system is used in the AZ2, although the elements are mounted on the inside edges of the spaceframes rather than on the floating beam. Strong and shadowless ambient lighting is provided by redundant metal halide HID light fixtures 15 adjustably mounted on pivoting brackets 173 which are in turn fixed to the floating beam 14. In storage, the lights are pivoted down and housed in recesses within the space frames 26, Alternatively, the brackets 173 may be rotatably mounted to swing beneath the floating beam to avoid contact with the spaceframe in the "container" configuration. Preferably the fixtures will have a color rendition index (CRI) of 81 or better and power draw is about 150W–300W in OR and 75W–50W in the Post-Op. Upon deployment the lights are directed upwards towards the reflective coating on the curved interior surface of the ceiling tenting in a fashion used in studio photography to provide even illumination throughout the operating theater to reduce or eliminate shadows. Halogen battery powered backup lights 176 are mounted under the floating beam, and preferably are triggered automatically by photocell 174 in the event of main power interruption from the utility module for short-term power interruptions and during metal halide fixture restarts.

FIGS. 14A through 14F show the patient flow patterns and operating procedure of the AZTEC 1 system.

Figure 14A:
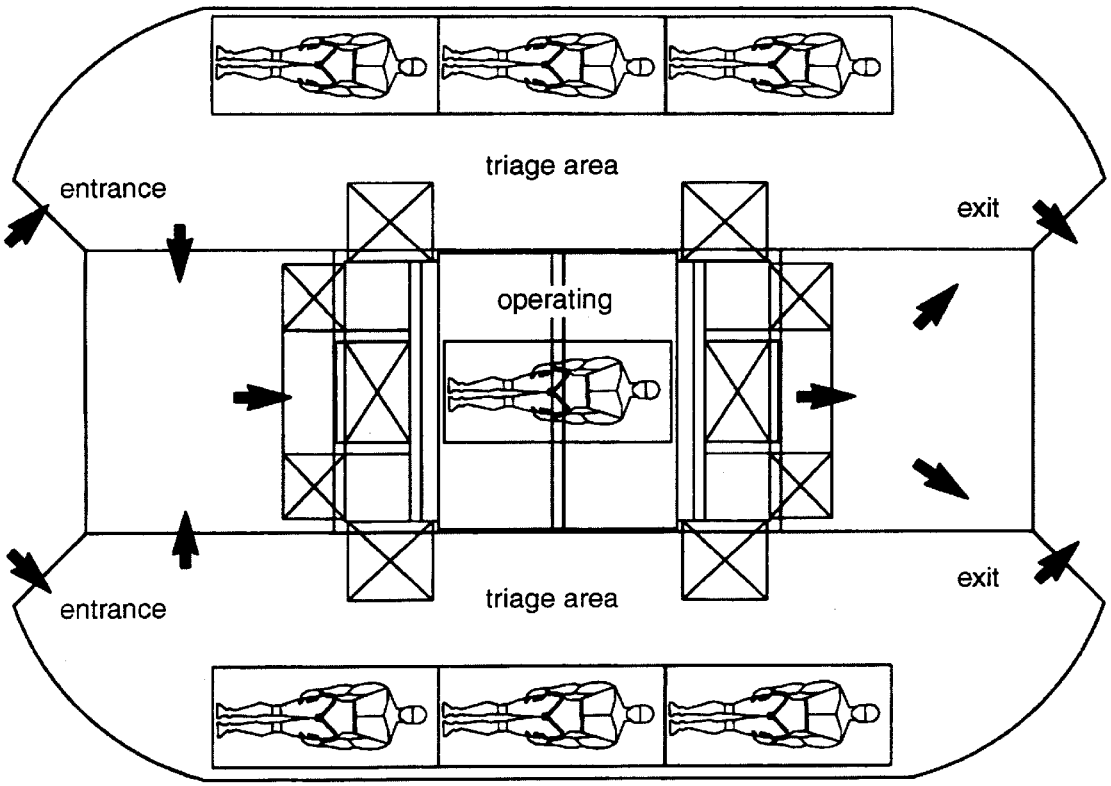
FIGS. 14A through 14F show the patient flow patterns and operating procedure of the AZTEC 1 system.

FIG. 14A shows the tenting around the AZTEC-1 which has two entrances and two exits. This figure also shows the patient flow pattern. The patients either come in on the left or right entrance where they are held in the triage area pending diagnosis and availability of the operating theater. From that point, they enter the operating theater along the longitudinal axis through the hinged doors as shown above. After operation, they exit out the right hand door back into one of the triage areas, or out the exit to a post-op module or for evacuation to a hospital.

Tenting around the AZTEC-1 has two entrances and two exits. Each entrance leads to the triage area that surrounds the core operating unit and can accommodate six patients in a single tier. Casualties are evacuated and prepared for procedures in the triage area. The tilt-down panels at each end of the core unit provide an elevated platform at the same height as the floor in the operating unit. Patient's path is a straight line from the entry platform, through the soft airlock, through the Operating Room and onto the exit platform. From there patients are taken to a tandem unit that serves as a Post Operative room.

Figure 14B:
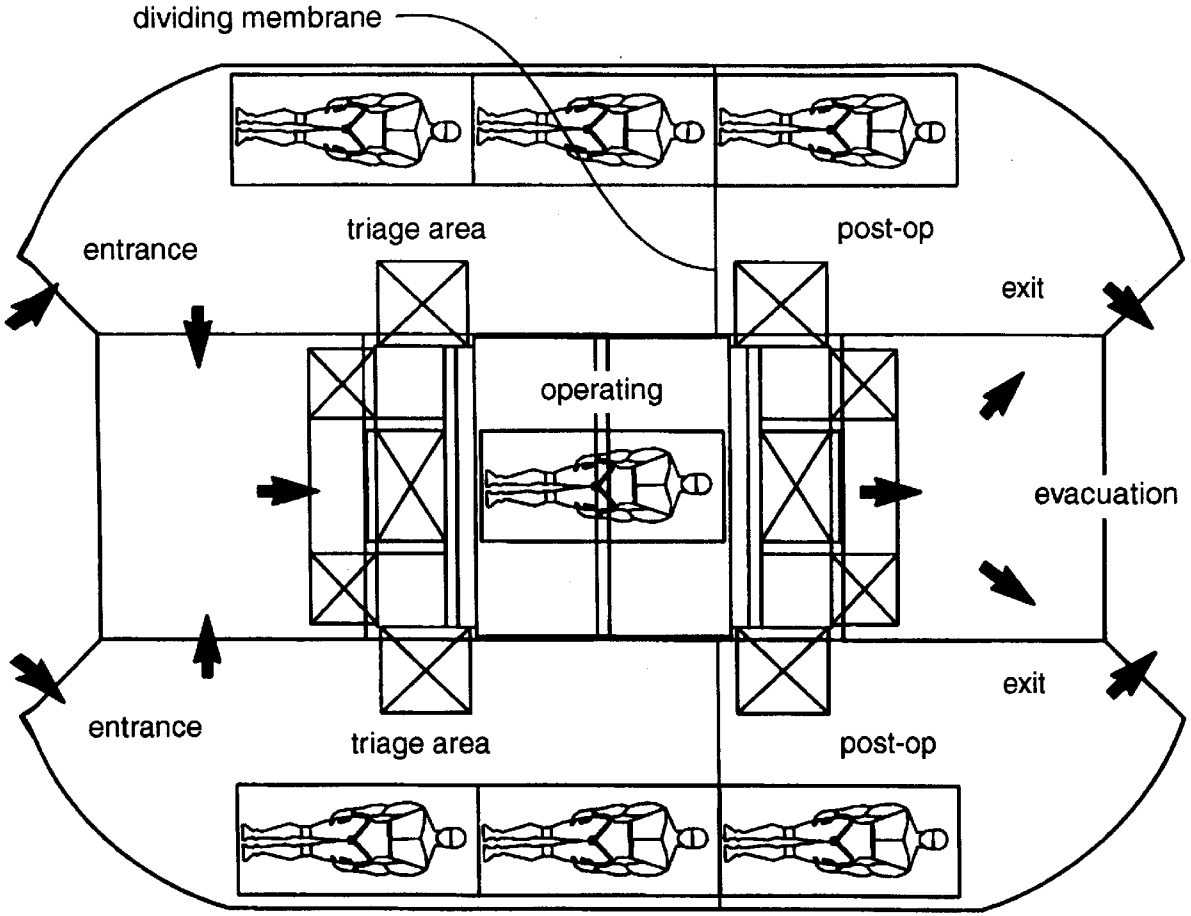

FIG. 14B shows the special operations configuration in the AZTEC-1 where dividing membranes are placed on either side of the core unit at one end thereon as shown to provide both a triage pre-operating area. As before, bunk beds configurations can be used.

Patient flow in the special operations configuration includes the triage and Post-Op functions inside of the same tent. The triage area is separated from the Post-Op area by a membrane. Triage area can contain four patients which could be doubled by the bunk-bed configuration. Patient path through the OR follows a straight line. Post-Op function is accommodated in two positions, one on each side of the exit platform.

Figure 14C:
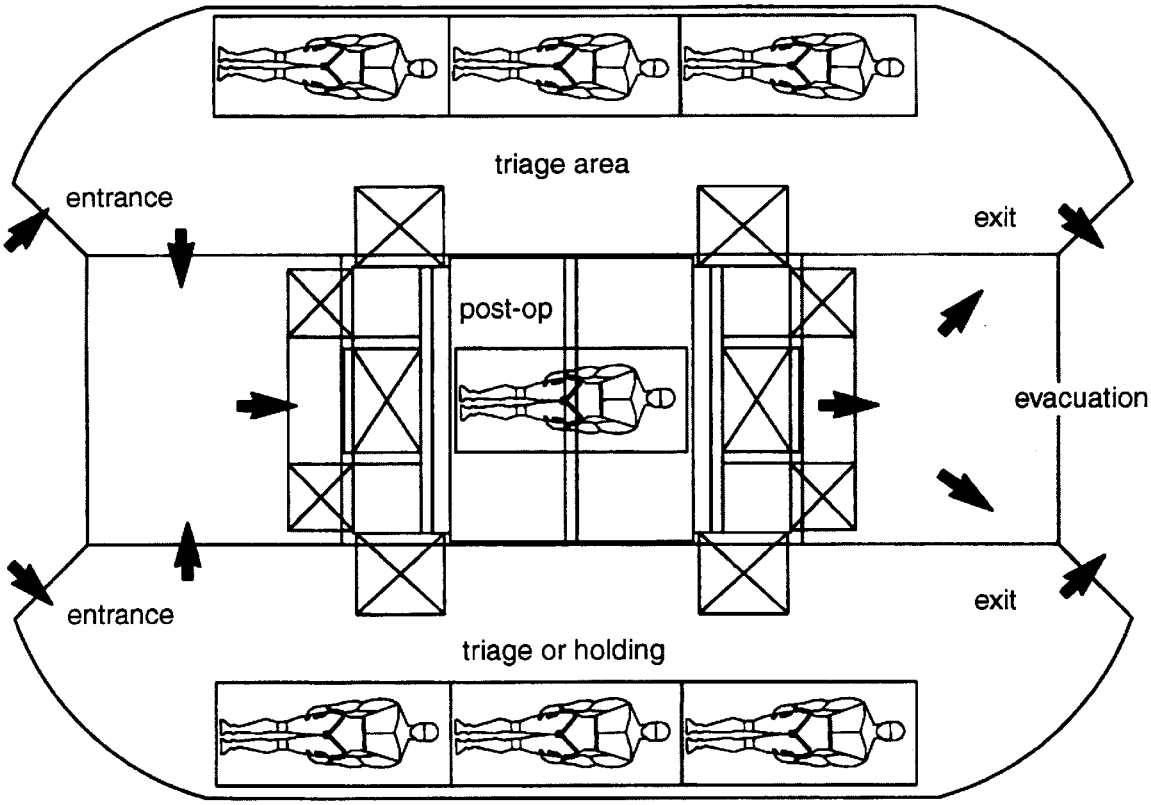

FIG. 14C shows the Post-Op unit of AZTEC-1. The Post-Op configuration is structurally identical to the OR unit, but can accommodate multiple patients in bunk bed (multi-tier) configurations as described above for the OR. Typically, in the OR there will not be bunk beds deployment which is more suitable for use in the Post-Op unit. The patient flow pattern is the same as in the OR unit and the space around the core provides additional room for triage treatment or a holding before evacuation. In a bunk bed situation, there an be as many as four to five high bunks for holding in case of mass disasters.

Figure 14D:
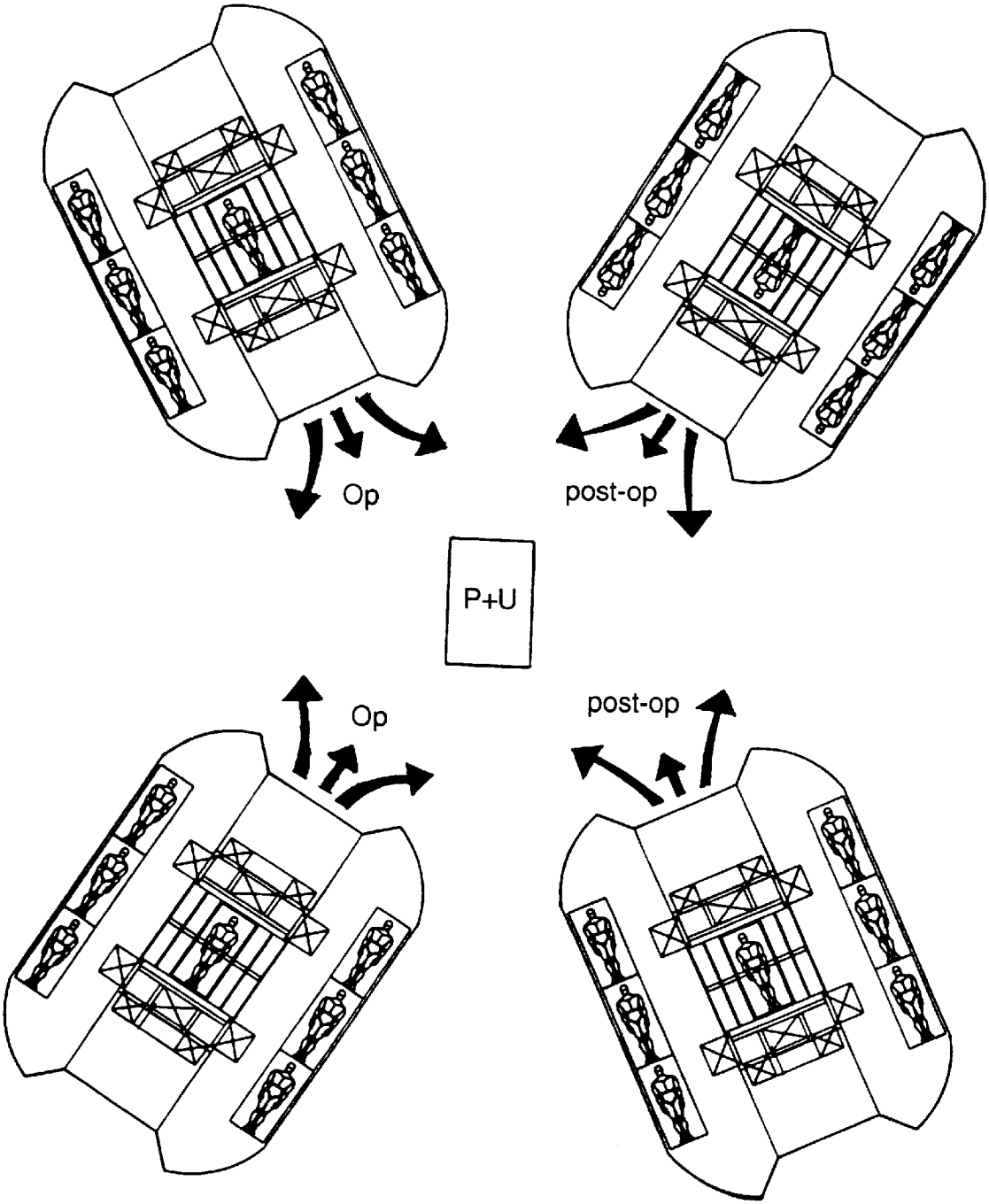

FIG. 14D shows the full AZTEC 1 system deployed in an X layout with two operation room and two post-op modules deployed facing a central power and utilities module, (P+U). Although many specific arrangements are feasible, the power/utility module is preferably near each medical module, and patient transport distance between modules is preferably minimized. The supply module may be positioned as convenient.

Figure 14E:
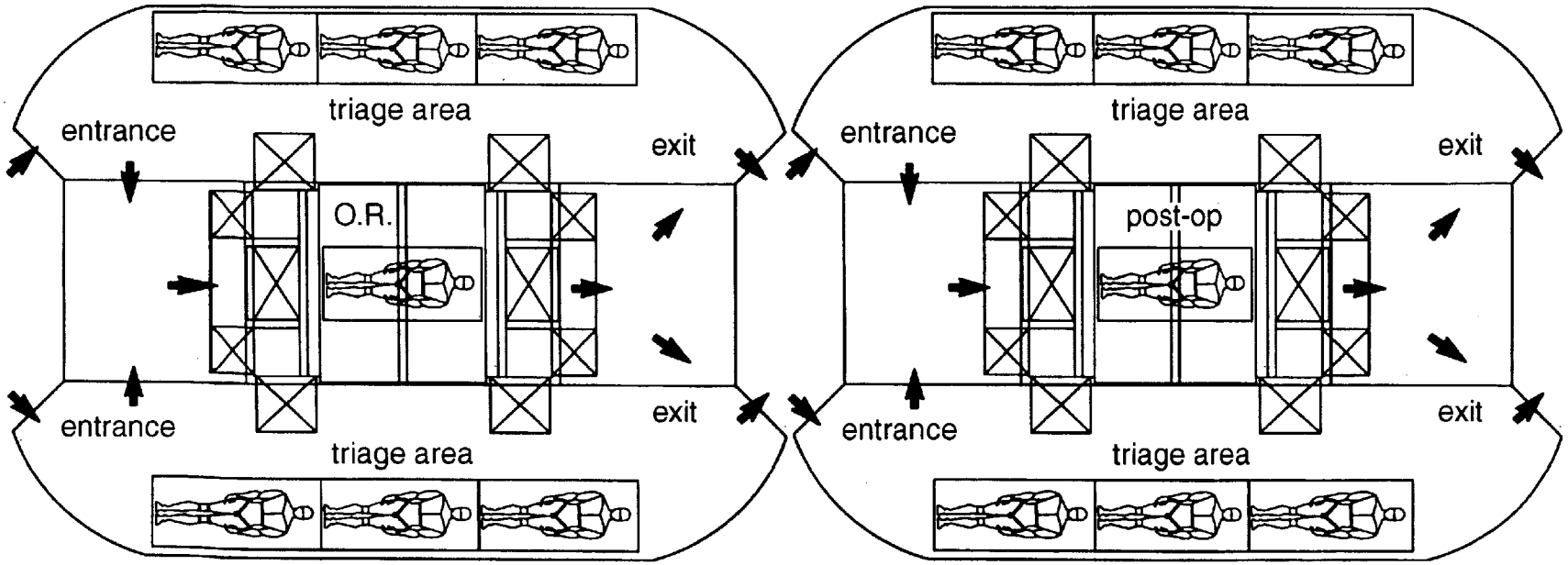
Figure 14F:
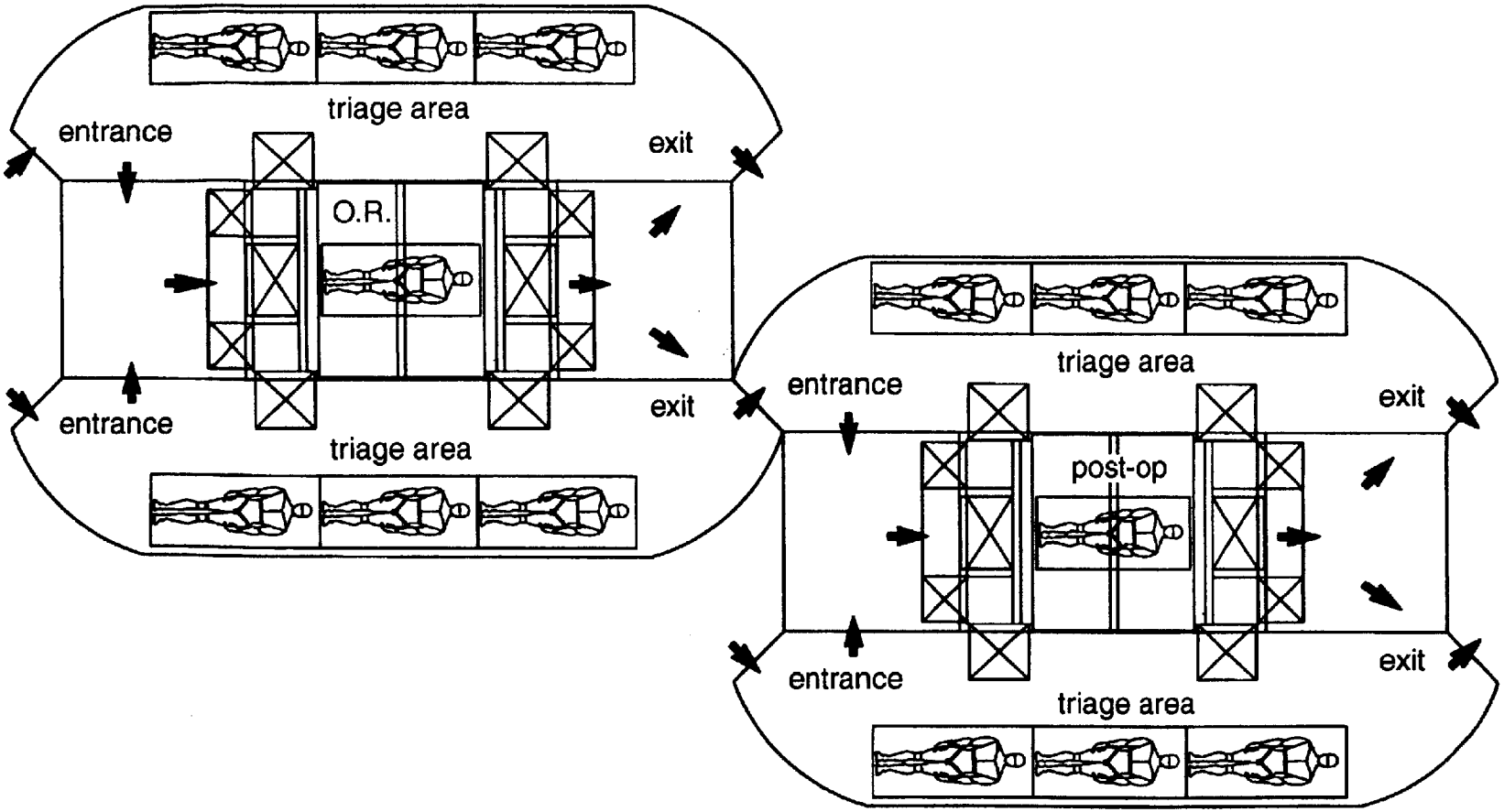

The two units may be placed end to end as shown in FIG. 14E, or offset as in FIG. 14F so that the exit from the OR is placed adjacent to the entrance of the Post-Op of another unit for direct access between modules. These optional configurations are most suitable for prepared, level sites where accurate module alignment is convenient, for example when parking lots or athletic fields are used in urban disaster relief operations.

Figure 15A:
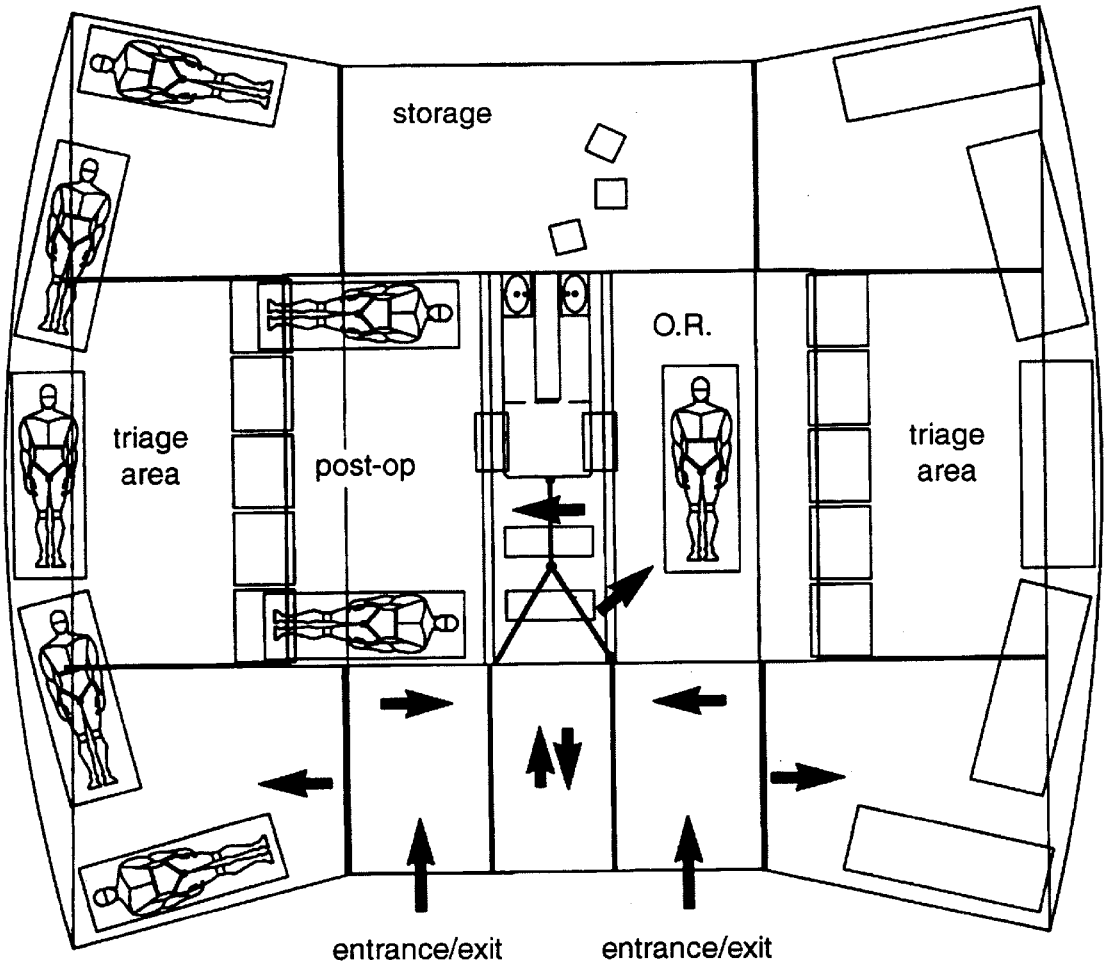
FIGS. 15A through 15C show the patient flow patterns and operating procedure of the AZTEC 2 system.
Figure 15B:
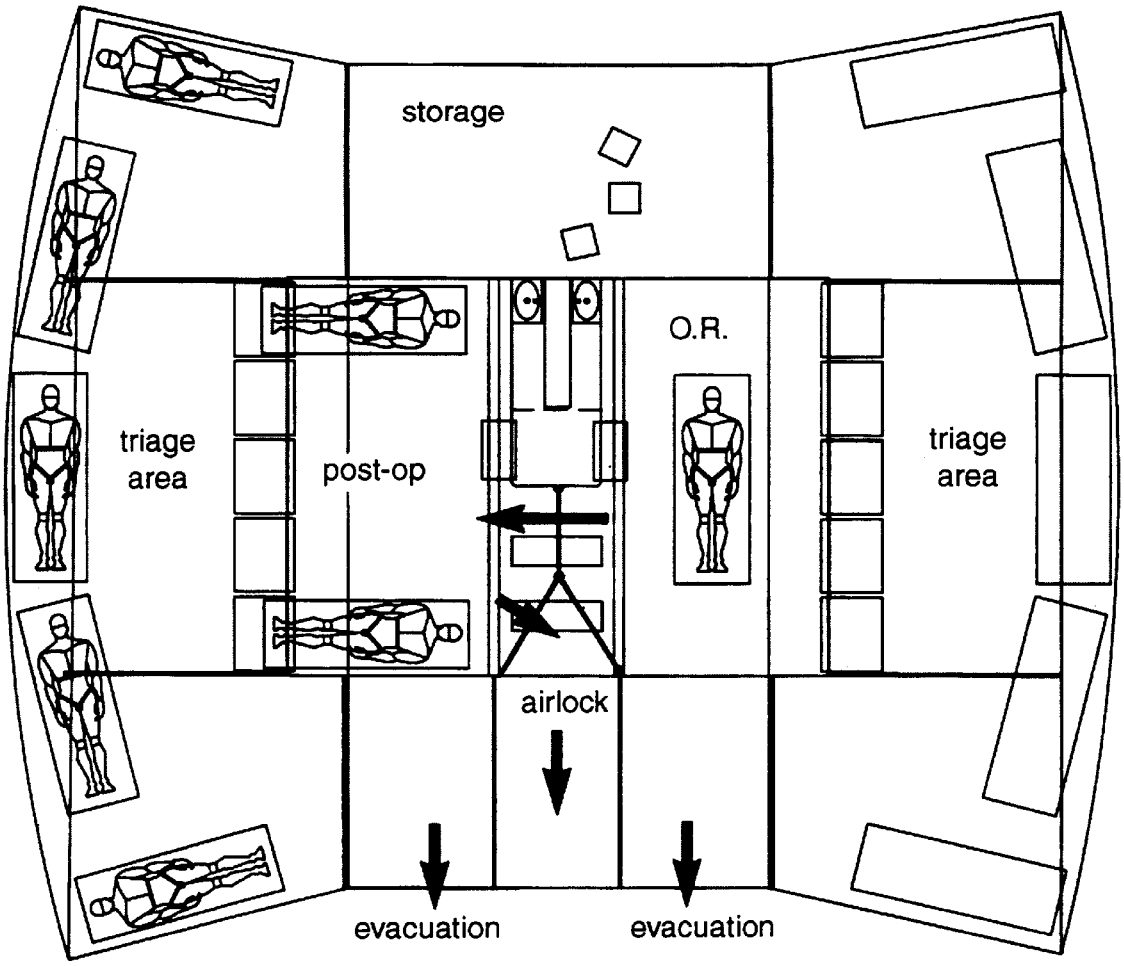
Figure 15C:
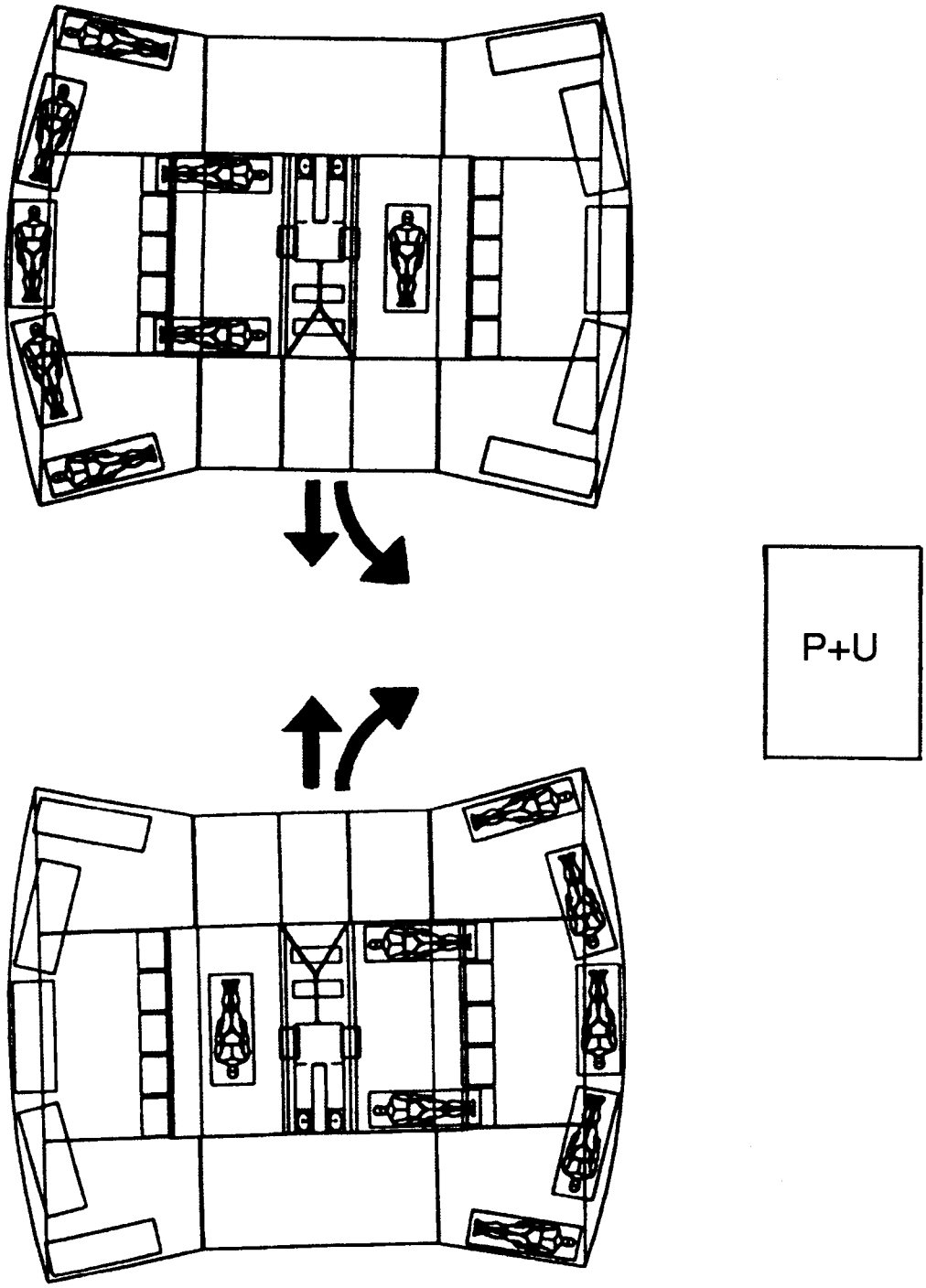

FIGS. 15A through 15C show the patient flow patterns and operating procedure of the AZTEC 2 system.

FIG. 15A shows the patient flow in the AZTEC-2 which includes an Operating Room for one patient and a Post-Op room for two patients as shown. There are two dual entrance/exits at one end of the AZTEC-2. From thence they go into the triage area for holding pending operating theater availability. If a patient is critical and an Operating Room is available they go directly into the OR through the center entrance. From there they go laterally into the Post-Op area, and thence back out to the triage holding or recovery area. The storage area is immediately behind the center core at the top of the figure.

Two entrances to the tented area are located on each side of the tilt-down panel leading to the core unit. There are two triage areas, each capable of holding six patients in a single tier. Multiple tiers are possible. Casualties are evaluated and prepared for procedures in these areas. The tilt-down panel at the side of the core unit provides an elevated platform at the same level as the floor inside. Patient path leads from the entry platform through a polyethylene membrane and into the Operating Room to the right. From there patients are taken to that post operative room through another membrane maintaining positive pressure between the OR and Post-Op.

FIG. 15B shows the patient flow for Post-Op in an AZTEC-2 unit where the tented side triage area can accommodate 12 patients in single tier bed configuration, and 25 to 30 in a multi-tier configuration.

Patients are located along the walls of the tent leaving central area or access to all patients and to external doors on the containers dedicated to servicing the triage area. Linear patient location provides or most efficient use of floor space. Separate entrances to each of the triage areas provide for an air lock before the entrance to the core unit.

FIG. 15C shows the full AZTEC 2 system deployed with two operation/post-op modules deployed adjacent a power and utilities module. The supply module may be positioned as convenient.

INDUSTRIAL APPLICABILITY

It is evident that the mobile modular Advanced Surgical Suite for Trauma Casualties or AZTEC has wide industrial applicability for rapid deployment, fast setup, and immediate response for diagnosis and treatment of non-critical casualties from both military activities and civilian disasters.

While the AZTEC system embodiments described in detail herein are principally optimized for the rapid treatment and stabilization of trauma victims, the present invention also has utility for the treatment of patients suffering from diseases and toxic conditions such as contagious diseases, environmental toxins, and chemical/biological/radioactive agents. To this end, the positive pressure environmental control may be extended to the tented perimeter areas by incorporation of joined tent flooring sealed to the perimeter walls and airlocks may be fitted to the exterior doorways. The HVAC unit may be enhanced or supplemented to remove chemical, biological or radioactive agents. The present invention can be adapted by one having ordinary skill in the art to be optimally employed for these and other medical and non-medical purposes, particularly for purposes which require a facility having the rapid flexible deployability, the self-contained environmentally controlled operation, and the quick, non-interruptive resupply aspects of the invention. The present invention can be adapted by one having ordinary skill in the art to be optimally employed for these and other medical and non-medical purposes, particularly for purposes which require a facility having the rapid flexible deployability, the self-contained environmentally controlled operation, and the quick, non-interruptive resupply aspects of the invention.

It should be understood that various modifications within the scope of this invention can be made by one of ordinary skill in the art without departing from the spirit thereof. We therefore wish our invention to be defined by the scope of the appended claims as broadly as the prior art will permit, and in view of the specification if need be.

We claim:

1. An advanced expandable/collapsible transportable field activity support suite, comprising in operative combination:

a) a core assembly including an extensible chassis having a first end and a second end and a first side and a second side;

b) a plurality of first telescoping cantilever beams housed within said chassis directed to telescope horizontally outward from said first end of said chassis at a plurality of intervals along said first end of said chassis;

c) a plurality of second telescoping cantilever beams housed within said chassis directed to telescope horizontally outward from said second end of said chassis at a plurality of intervals along said second end of said chassis;

d) a first spaceframe fixedly mounted to, and extending upwards from, the outward ends of each of said first telescoping beams;

e) a second spaceframe fixedly mounted to, and extending upwards from, the outward ends of each of said second telescoping beams;

f) a first foldable pair of vertically oriented sidepanels connected to each other and to each of said spaceframes by vertical hinges such that said first pair of sidepanels are folded inwardly along said hinge when said telescoping beams are housed within said chassis, and such that said first pair of sidepanels are unfolded towards a co-planar orientation with respect to each other when said telescoping beams are extended from within said chassis, said unfolded sidepanels being generally contiguous with said first side of said chassis;

g) a second foldable pair of vertically oriented sidepanels connected to each other and to each of said spaceframes by vertical hinges such that said second pair of sidepanels are folded inwardly along said hinge when said telescoping beams are housed within said chassis, and such that said second pair of sidepanels are unfolded towards a co-planar orientation with respect to each other when said telescoping beams are extended from within said chassis, said unfolded sidepanels being generally contiguous with said second side of said chassis;

h) a deployable folded tent roof mountable upon said spaceframes and storable in association with said core assembly;

i) expansion mechanism for extending said telescoping beams from said chassis until said pairs of side panels are unfolded to said co-planar orientation;

j) a plurality of members which maintain said roof in a deployed condition to enclose the volume created upon extension of said telescoping beams outward from said chassis;

k) at least one of said first and second spaceframes includes:

i) space for occupancy upon suite deployment; and ii) at least one cabinet assembly for housing material selected from equipment, supplies and consumables; and l) said cabinet assembly includes mounting members to move said cabinet between a first stowed position within the interior of said spaceframe and a second accessibly deployed position substantially outside the interior of said spaceframe, so that said cabinet does not substantially intrude into said occupancy space.

2. A field support suite as in claim 1, including at least one deployable tent structure configured to define upon deployment an enclosed personnel perimeter space around at least a portion of said core assembly.

3. A field support suite as in claim 2, wherein at least one of said tent roof and tent structure comprises:

a) a plurality of flexible, curved battens, at least some of said battens are mountable to at least one of said spaceframe and said chassis;

b) a tent membrane; and c) said battens are mountable to said membrane to maintain at least a portion of the tent membrane in tension to withstand substantial loads.

4. A field support suite as in claim 3, wherein said tent structure is stored in association with said core assembly when said suite is collapsed, said tent structure being mountable to and supported at least in part by at least one of said spaceframes and said chassis when said suite is expanded to its deployed configuration.

5. A field support suite as in claim 4, including:

a) at least one airlock mounted to said suite for providing passage for ingress to and egress from the interior space of said suite for controlling airflow into and out of said suite interior; and b) at least one HVAC/filtration unit in communication with said suite space for providing a positive-pressure flow of filtered air into said suite space to reduce contamination within said suite interior.

6. A field support suite as in claim 2, wherein said suite includes prepackaged equipment and supplies for deployment as a medical/surgical suite.

7. A field support suite as in claim 6, wherein said cabinet includes at least one sealable opening accessible from inside said deployed suite and at least one sealable opening accessible from outside of said deployed suite.

8. A field support suite as in claim 7, wherein said cabinet includes an interlock mechanism for preventing both said inside opening and said outside opening from being unsealed at the same time.

9. A method of deploying a compact module for deployment as a field activity support unit, said module including a structural core assembly having at least one expandable spaceframe mounting at least one movable accessibly deployable cabinet, a plurality of vertically extensible pylons, and roof support elements selected from panels, tent membranes, guy wires, spars, and tent support battens, and sidewalls, said method comprising in any order the steps of:

a expanding said space frame to a fully operational extended configuration providing interior workspace;

b) deploying said cabinet to a position substantially outside the interior of said expanded spaceframe, so that said cabinet does not substantially intrude into said workspace;

c) extending vertical pylons and supporting roof elements therefrom;

d) enclosing area around said core with tent roof and sidewalls to provide a use perimeter between said core and said sidewalls; and e) connecting utilities to said core to render operational.

10. A method of deploying a compact module as in claim 9, said field support unit module including equipment or supplies for deployment as a medical/surgical suite, said module including at least one airlock and at least one HVAC/filtration unit, further comprising the steps of:

a) positively pressurizing said suite with filtered air from said HVAC/filtration unit to reduce airborne contamination of said suite; and b) controlling the flow of air into and out of said suite via said airlock.

11. A compact portable module for deployment as a tented field activity support unit, comprising in operative combination:

a) a structural core assembly comprising at least one expandable space frame deployable at least one of horizontally and vertically from a collapsed, compact, transportable configuration to a fully operational, extended, deployed configuration defining an interior workspace;

b) said core assembly having telescoping members including at least one of extensible chassis members and vertically extensible roof support pylons to assist in support of a roof of said tent;

c) said core assembly in said collapsed transportable stowed configuration forming a closed box structure having enclosing handling-resistant exterior panels; and, d) said core assembly including at least one cabinet for housing at least one of equipment, supplies and consumables, said cabinet deployable from a first, stowed position in the interior volume of said module in said collapsed transportable configuration to a second deployed, use position, so that said cabinet does not substantially intrude into said workspace in the expanded deployed configuration of said core.

12. A compact module as in claim 11, including a deployable tent structure configured to enclose said core assembly in its fully deployed extended configuration and provide an enclosed personnel perimeter space around at least a portion of said core assembly.

13. A compact module as in claim 12, wherein:

a) said structural core assembly includes an extensible chassis having a top, a first end and a second end and a first side and a second side;

b) said laterally extensible chassis members include a plurality of telescoping cantilever beams housed within said chassis and telescopingly mounted to said chassis at spaced intervals along at least one of said chassis ends to telescope horizontally outward from said end of said chassis;

c) said spaceframe being fixedly mounted to, and extending upwards from, the outward ends of said telescoping beams;

d) said structural core assembly includes at least one folded pair of vertically oriented sidepanels pivotally connected to each other and to at least one spaceframe by vertical hinges such that said pair of sidepanels are folded when said telescoping beams are housed within said chassis, and such that said pair of sidepanels are unfolded towards a generally co-planar orientation with respect to each other and said first side of said chassis when said telescoping beams are extended from within said chassis;

e) said tent structure includes a deployable folded tent roof mountable upon at least one of said spaceframe and said chassis, said folded tent structure is storable in association with at least one of said spaceframe and said chassis;

f) expansion mechanism to extend said telescoping beams from said chassis until said pair of side panels is unfolded to said co-planar orientation; and g) a plurality of members which maintain said roof in a deployed condition to enclose the volume created upon extension of said telescoping beams outward from said chassis.

14. A compact module as in claim 12, wherein said tent structure comprises:

a) a plurality of flexible, curved battens;

b) at least one tent membrane; and c) said battens are mountable to said membrane to form therewith a semi-rigid arched surface capable of withstanding substantial loads.

15. A compact module as in claim 14, wherein at least some of said battens are mountable to at least one of said spaceframe and said chassis.

16. A compact module as in claim 14, wherein said tent structure is stored in association with said module in its collapsed configuration, said tent structure being mountable to and supported at least in part by at least one of said spaceframes and said chassis.

17. A compact module as in claim 12, wherein said module includes prepackaged equipment and supplies for deployment as a medical/surgical suite.

18. A compact module as in claim 17, including:

a) at least one airlock mounted to said suite for providing passage for ingress to and egress from the interior space of said suite for controlling airflow into and out of said suite interior; and b) at least one HVAC/filtration unit in communication with said suite space for providing a positive-pressure flow of filtered air into said suite space to reduce contamination within said suite interior.

19. A compact module as in claim 17, wherein said cabinet includes at least one sealable opening accessible from inside said deployed suite and at least one sealable opening accessible from outside of said deployed suite.

20. A compact module as in claim 19, wherein said deployable cabinet includes an interlock mechanism for preventing both said inside opening and said outside opening from being unsealed at the same time.

* * * * *